US009091159B2

(12) United States Patent
Chhina et al.

(10) Patent No.: US 9,091,159 B2
(45) Date of Patent: Jul. 28, 2015

(54) PROCESS AND WELL ARRANGEMENT FOR HYDROCARBON RECOVERY FROM BYPASSED PAY OR A REGION NEAR THE RESERVOIR BASE

(71) Applicants: Harbir Chhina, Calgary (CA); Stephen Raffa, Calgary (CA); Jillian Tofer, Calgary (CA); Steven Wall, Calgary (CA)

(72) Inventors: Harbir Chhina, Calgary (CA); Stephen Raffa, Calgary (CA); Jillian Tofer, Calgary (CA); Steven Wall, Calgary (CA)

(73) Assignee: FCCL Partnership, Calgary (CA)

( * ) Notice: Subject to any disclaimer, the term of this patent is extended or adjusted under 35 U.S.C. 154(b) by 0 days.

(21) Appl. No.: 13/708,846

(22) Filed: Dec. 7, 2012

(65) Prior Publication Data

US 2013/0146285 A1 Jun. 13, 2013

Related U.S. Application Data

(60) Provisional application No. 61/568,439, filed on Dec. 8, 2011.

(51) Int. Cl.

| | |
|---|---|
| ***E21B 43/24*** | (2006.01) |
| ***E21B 43/00*** | (2006.01) |
| ***E21B 43/30*** | (2006.01) |

(52) U.S. Cl.

CPC ..... *E21B 43/2406* (2013.01); *E21B 43/00* (2013.01); *E21B 43/2408* (2013.01); *E21B 43/30* (2013.01); *E21B 43/305* (2013.01)

(58) Field of Classification Search

CPC ..... E21B 43/24; E21B 43/30
USPC ..... 166/245, 272, 292, 50
See application file for complete search history.

(56) References Cited

U.S. PATENT DOCUMENTS

| | | | | |
|---|---|---|---|---|
| 3,868,999 | A * | 3/1975 | Christopher et al. | 166/292 |
| 4,022,279 | A * | 5/1977 | Driver | 166/271 |
| 4,344,485 | A * | 8/1982 | Butler | 166/271 |
| 4,577,691 | A * | 3/1986 | Huang et al. | 166/272.3 |

(Continued)

FOREIGN PATENT DOCUMENTS

| | | |
|---|---|---|
| CA | 1304287 | 6/1992 |
| CA | 2594413 A1 | 7/2006 |
| CA | 2591498 A1 | 12/2007 |

OTHER PUBLICATIONS

Burinda et al., Geosteering Techniques in Thin Coal Reservoirs, 2009, pp. 3-4.*

(Continued)

*Primary Examiner* — Angela M DiTrani
*Assistant Examiner* — Avi Skaist
(74) *Attorney, Agent, or Firm* — Christie, Parker & Hale, LLP

(57) ABSTRACT

Hydrocarbons may be produced from a well which comprises a contour section that follows a contour of a depression on a contoured base above which the reservoir is formed. Hydrocarbons may also be produced from a first well in a gravity-controlled recovery process and a second well which extends under and across the first well. For recovery of hydrocarbons from a reservoir, a pair of injection and production wells may be positioned and configured to optimize an initial rate of production from a pay region in the reservoir, and another well for producing hydrocarbons may be located below the production well and be positioned and configured to optimize an amount of hydrocarbon recovery from the pay region.

26 Claims, 15 Drawing Sheets

(56) References Cited

U.S. PATENT DOCUMENTS

| | | | | |
|---|---|---|---|---|
| 4,611,855 | A * | 9/1986 | Richards | 299/2 |
| 4,637,461 | A * | 1/1987 | Hight | 166/245 |
| 5,016,709 | A * | 5/1991 | Combe et al. | 166/245 |
| 5,025,859 | A * | 6/1991 | Hanson et al. | 166/252.1 |
| 5,273,111 | A * | 12/1993 | Brannan et al. | 166/245 |
| 5,318,124 | A * | 6/1994 | Ong et al. | 166/272.3 |
| 5,407,009 | A | 4/1995 | Butler et al. | |
| 5,462,120 | A * | 10/1995 | Gondouin | 166/380 |
| 5,868,210 | A * | 2/1999 | Johnson et al. | 175/40 |
| 6,230,814 | B1 * | 5/2001 | Nasr et al. | 166/400 |
| 6,257,334 | B1 * | 7/2001 | Cyr et al. | 166/272.7 |
| 6,318,464 | B1 * | 11/2001 | Mokrys | 166/252.1 |
| 6,708,764 | B2 * | 3/2004 | Zupanick | 166/313 |
| 7,066,254 | B2 * | 6/2006 | Vinegar et al. | 166/245 |
| 7,493,951 | B1 * | 2/2009 | Kravits et al. | 166/245 |
| 2007/0044957 | A1 * | 3/2007 | Watson et al. | 166/245 |
| 2007/0295499 | A1 * | 12/2007 | Arthur et al. | 166/245 |
| 2009/0288827 | A1 * | 11/2009 | Coskuner | 166/272.3 |
| 2010/0163229 | A1 * | 7/2010 | Nenniger | 166/272.3 |
| 2011/0011582 | A1 * | 1/2011 | Sarathi et al. | 166/260 |
| 2011/0232903 | A1 * | 9/2011 | Dreher et al. | 166/270 |
| 2011/0272153 | A1 * | 11/2011 | Boone et al. | 166/270 |
| 2013/0043025 | A1 | 2/2013 | Scott | |
| 2014/0124194 | A1 * | 5/2014 | Jorshari | 166/245 |

OTHER PUBLICATIONS

Burinda et al., Geosteering Techniques in Thin Coal Reservoirs, 2009.*

Subterranean Reservoir and Pipe of a Geyser in Iceland (1830).*

Reservoir Types (Wyoming State Geological Survey).*

Directional Drilling Guide—pp. D40-D41.*

Stalder et al. "Multilateral-Horizontal Wells Increase Rate and Lower Cost per Barrel" (2001).*

"Cenovus enters blowdown phase at Foster Creek", Oil and Gas Inquirer Report, May 27, 2013, found online at <http://www.oilandgasinquirercom/index.php/news/regional/northeastern-alberta/468-cenovus-enters-blowdown-phase-at-foster-creek> (retrieved Dec. 11, 2014).

Mark Lowey, "Getting Old with Grace", JuneWarren-Nickle's Energy Group, Feb. 1, 2014, found online at <http://www.junewarren-nickles.com/feature.aspx?id=9541> (retrieved Dec. 11, 2014).

Pat Roche, "SAGDo SAGDon't", New Technology Magazine, Aug. 27, 2014, found online at <http://www.newtechmagazine.com/index.php/oilpatch-news/feature/11119-sagdo-sagdon-t> (retrieved Dec. 11, 2014).

* cited by examiner

PROCESS AND WELL ARRANGEMENT FOR HYDROCARBON RECOVERY FROM BYPASSED PAY OR A REGION NEAR THE RESERVOIR BASE

CROSS-REFERENCE TO RELATED APPLICATION

This application claims benefits of, and priority from, U.S. provisional patent application No. 61/568,439 filed on Dec. 8, 2011, the contents of which are incorporated herein by reference.

FIELD OF THE INVENTION

The present invention relates generally to in situ thermal processes for recovering hydrocarbon from oil sands, and particularly to steam-assisted gravity drainage recovery processes.

BACKGROUND OF THE INVENTION

Some subterranean deposits of viscous petroleum can be extracted in situ by lowering the viscosity of the petroleum to mobilize it so that it can be moved to, and recovered from, a production well. Reservoirs of such deposits may be referred to as reservoirs of heavy hydrocarbon, heavy oil, bitumen, tar sands, or oil sands. The in situ processes for recovering oil from oil sands typically involve the use of multiple wells drilled into the reservoir, and are assisted or aided by injecting a heated fluid such as steam into the reservoir formation from an injection well.

For example, one process for recovering viscous hydrocarbons is known as steam-assisted gravity drainage (SAGD). A typical SAGD process utilizes one or more pairs of vertically spaced horizontal wells. Various embodiments of the SAGD process are described in Canadian Patent No. 1,304,287 and corresponding U.S. Pat. No. 4,344,485. In a SAGD process, steam is pumped through an upper, horizontal, injection well into a viscous hydrocarbon reservoir while hydrocarbons are produced from a lower, parallel, horizontal, production well vertically spaced proximate to the injection well. The injection and production wells are typically located near, but some distance above, the bottom of the primary pay zone in the hydrocarbon deposit. In a SAGD process, the injected steam initially mobilises the in-place hydrocarbons to create a "steam chamber" in the reservoir around and above the horizontal injection well. The term "steam chamber" means the volume of the reservoir which is saturated with injected steam and from which mobilised oil has at least partially drained. As the steam chamber expands upwardly and laterally from the injection well, viscous hydrocarbons in the reservoir are heated and mobilised, especially at the margins of the steam chamber where the steam condenses and heats a layer of viscous hydrocarbons by thermal conduction. The mobilised hydrocarbons (and aqueous condensate) drain under the effects of gravity towards the bottom of the steam chamber, where the production well is located. The mobilised hydrocarbons are collected and produced from the production well. The rate of steam injection and the rate of hydrocarbon production may be modulated to control the growth of the steam chamber to ensure that the production well remains located at the bottom of the steam chamber in an appropriate position to collect mobilised hydrocarbons.

Alternative recovery processes may employ thermal and non-thermal components to mobilise oil. For example, light hydrocarbons may be used to mobilise heavy oil. U.S. Pat. No. 5,407,009 teaches an exemplary technique of injecting a hydrocarbon solvent vapour, such as ethane, propane or butane, to mobilise hydrocarbons in the reservoir.

While it is common to position the production wells at the lower portion of the reservoir to maximize the economic benefit of the recovery operation, the horizontal sections of the production wells are normally positioned about 2 m or more above the base due to practical and economic considerations. For instance, it is generally considered good practice when drilling production wells to limit the inclination of the well to within 5 m. That is, the elevation difference between the toe of the well and the heel of the well is less than about 5 m. It is also considered good practice in a SAGD setup to ensure that no portion of the production well is higher than any portion of the injection well. Thus, the inclination of the wells is also limited by the vertical separation between the injection well and the production well, which is typically about 5 m. As is commonly known, the depth in a reservoir can be expressed as the measured depth (MD), the true vertical depth (TVD), or the TVD subsea (TVDSS). A known technique for completing a perforated portion of a well is the tubing-conveyed perforating (TCP) completion technique. A common tool for measuring oil saturation (typically denoted as So) in the reservoir is known as the Reservoir Saturation Tool (RST).

SUMMARY OF THE INVENTION

In accordance with an aspect of the present invention, there is provided a process comprising producing hydrocarbons from a well in a subterranean reservoir, wherein the reservoir is formed above a contoured base and the well comprises a contour section that follows a contour of a depression on the contoured base. The well may extend over the lowest region of the depression. The well may extend in a valley or a basin defined by the contoured base. The well may comprise a branched well bore comprising a plurality of lateral branches, and the contour section may be in a lateral branch of the branched well bore. The well may penetrate a water-rich region above the depression. A maximum distance between the contour section of the well and the contoured base may be from 0 to 3 m. Before producing hydrocarbons from the well, hydrocarbons may be produced from one or more production wells in the reservoir in a gravity-controlled recovery process, wherein the contour section of the well may extend between the one or more production wells and the contoured base. A distance between each one of the production well(s) and the contoured base may be more than 3 m. At least one of the production well(s) may comprise a branched well bore, and the contour section may extend between the contoured base and one or more branches of the branched well bore. Hydrocarbons may be produced from a plurality of wells each comprising a contour section that follows a contour of the contoured base.

In another aspect of the present invention, there is provided a well for producing hydrocarbons from a subterranean reservoir formed above a contoured base. The well comprises a contoured well bore section that follows a contour of a depression on the contoured base. The well may extend over the lowest region of the depression. The well may extend in a valley or a basin defined by the contoured base. The well may comprise a branched well bore comprising a plurality of lateral branches. The well may penetrate a water-rich region above the depression. A maximum distance between the contoured well bore section and the contoured base may be from 0 to 3 m. The well may extend between one or more production wells in the reservoir and the contoured base. A distance between the production well(s) and the contoured base may be more than 3 m. At least one of the production well(s) may comprise a branched well bore comprising a plurality of lateral branches, and wherein the contoured well bore section may extend between the contoured base and one or more lateral branches of the branched well bore of the at least one production well.

In a further aspect of the present invention, there is provided a process comprising producing hydrocarbons from a first well in a subterranean reservoir in a gravity-controlled recovery process; and producing hydrocarbons from a second well in the subterranean reservoir, wherein the second well extends under and across the first well. Hydrocarbons may be produced from the first well before producing hydrocarbons from the second well. The gravity-controlled recovery process may be a steam-assisted gravity drainage (SAGD) process, and the first well may be a production well for the SAGD process. The second well may follow a contour of the base above which the reservoir is formed. The second well may penetrate a water-rich region above the base. The second well may comprise a branched well bore comprising a plurality of lateral branches. The first well may comprise a branched well bore comprising a plurality of lateral branches, and the second well may extend under one or more lateral branches of the branched well bore of the first well. Hydrocarbons may be produced from a plurality of first wells in the reservoir, and the second well may extend under at least two of the plurality of first wells. The first wells may extend substantially horizontally and parallel to one another. A section of the second well under the first well may be shielded from receiving fluids from the reservoir, so as to limit interference with production of the fluids from the first well.

In another aspect of the present invention, there is provided an arrangement of wells for producing hydrocarbons from a subterranean reservoir, comprising a first well in the reservoir for producing hydrocarbons from the reservoir in a gravity-controlled recovery process; and a second well in the reservoir for producing hydrocarbons from the reservoir, the second well extending under and across the first well. A section of the second well under the first well may be shielded from receiving fluids from the reservoir, so as to limit interference with production of the fluids from the first well. The second well may follow a contour of the base above which the reservoir is formed. The second well may penetrate a water-rich region above the base. The second well may comprise a branched well bore comprising a plurality of lateral branches. The gravity-controlled recovery process may be a SAGD process, and the first well may be a production well for the SAGD process. The first well may comprise a branched well bore comprising a plurality of lateral branches, and wherein the second well extends under one or more lateral branches of the branched well bore of the first well. The arrangement may comprise a plurality of first wells in the reservoir for producing hydrocarbons from the reservoir, and the second well may extend under at least two of the first wells. The first wells may extend substantially horizontally and parallel to one another. The arrangement may comprise a plurality of second wells each extending under at least one first well.

In a further aspect of the present invention, there is provided a process for producing hydrocarbons from a subterranean hydrocarbon reservoir, comprising injecting steam from a first well into the reservoir to mobilize hydrocarbons in the reservoir and producing hydrocarbons from a second well located in the reservoir under the first well, wherein the first and second wells are positioned and configured to optimize an initial rate of hydrocarbon production from a pay region of the reservoir; and producing hydrocarbons from a third well located in the reservoir below the second well, wherein the third well is positioned and configured to optimize an amount of hydrocarbon recovery from the pay region of the reservoir. The process may comprise any process described herein. Production of hydrocarbons from the third well may begin after a period of production of hydrocarbons from the second well.

In another aspect of the present invention, there is provided an arrangement of wells for producing hydrocarbons from a subterranean hydrocarbon reservoir, comprising a first well for injecting steam into the reservoir to mobilize hydrocarbons in the reservoir and a second well located in the reservoir under the first well for producing hydrocarbons from the reservoir, wherein the first and second wells are positioned and configured to optimize an initial rate of hydrocarbon production from a pay region of the reservoir; and a third well located in the reservoir below the second well, wherein the third well is positioned and configured to optimize an amount of hydrocarbon recovery from the pay region of the reservoir. The arrangement may comprise any arrangement as described herein.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

Figure 1:
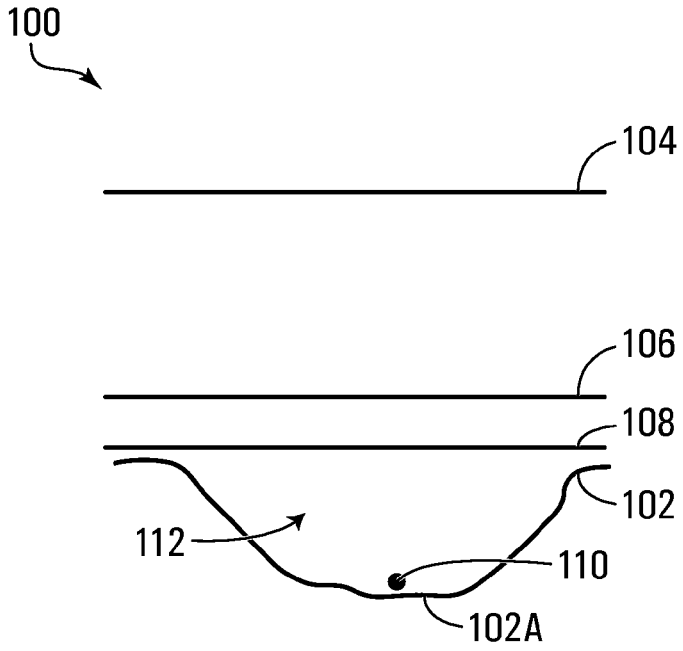
FIGS. 1 and 2 are schematic elevation section views of arrangements of wells in a reservoir, according to selected embodiments of the present invention.

In overview, it has been recognized that after hydrocarbons are produced from one or more production wells above the base of a hydrocarbon reservoir, such as a production well in a steam-assisted gravity drainage (SAGD) process, additional hydrocarbons can be economically produced from the region near the base below the production well, by providing a bypassed pay well that follows the contour of the base or an underlying well that extends under and across the overlying production well(s). An underlying well may also be a bypassed pay well.

In selected embodiments, an arrangement of wells for producing hydrocarbons from a subterranean hydrocarbon reservoir may include an injection well for injecting steam into the reservoir to mobilize hydrocarbons in the reservoir and a production well located in the reservoir under the injection well for producing hydrocarbons from the reservoir. The injection and production wells are positioned and configured to optimize initial rate of hydrocarbon production from a pay region of the reservoir, and may be arranged as a conventional SAGD well pair. For a given well pad or site, multiple well pairs may be provided in a pattern according to techniques known to those skilled in the art to optimize the SAGD operation, and the factors to be balanced may include rate of hydrocarbon production, steam-to-oil ratio, and costs of drilling, equipment, operation, and maintenance, or the like. One or more additional bypassed pay wells may be located in the reservoir below one or more production wells, and may be positioned and configured to optimize an amount of hydrocarbon recovery from the same pay region of the reservoir. Example arrangements of bypassed pay wells are shown in the figures and discussed below. However, it should be understood that other arrangements may also be possible in different situations depending on factors such as reservoir structures, existing facilities and wells, operational histories, current economy for production, or the like. The timing of production from the SAGD production well(s) and from the bypassed pay wells may be selected and optimized according to a number of considerations.

In some cases, a bypassed pay well or underlying well may be planned, or even drilled, when the SAGD well pairs are planned or drilled. In some cases, it may not be economical or practical to use certain types of bypassed pay wells or underlying wells at the time when the SAGD well pairs are drilled, but it may later become economical and practical to produce from one or more such bypassed pay wells, in which cases the bypassed pay well(s) may be planned and drilled after a certain period of production from the original SAGD wells. A bypassed pay well or underlying may be operated to produce hydrocarbons immediately after completion of the well, or production from the well may be delayed to optimize the timing depending the operation results from the SAGD wells.

To operate a bypassed pay well to produce hydrocarbons from a bypassed pay region, additional reservoir stimulation such as steam injection may not be necessary in some cases. For example, heat from a steam chamber generated by nearby SAGD wells may be conducted into the bypassed pay region which may have sufficiently mobilized the petroleum or bitumen in the bypassed pay region. Further heat may also be supplied to the bypassed pay region when the bypassed pay well and the nearby SAGD wells are operated concurrently. Petroleum or bitumen mobilized in other regions at a higher elevation may have drained into the bypassed pay region under gravity and accumulated there due to an impermeable barrier below the bypassed pay region. In these cases, a bypassed pay well may be operated to produce hydrocarbons without further reservoir stimulation such as steam injection into the bypassed pay well.

However, in some cases, stimulation techniques such steam or solvent injection may be utilized, either alone or in combination, to aid recovery of hydrocarbons from a bypassed pay well. Injection of a fluid such as steam or solvent may be accomplished using the bypassed pay well itself, in which case the bypassed pay well may be configured for both injection and production. Such a well may be operated in an injection mode first to inject a fluid into the bypassed pay region and then be switched to a production mode to produce hydrocarbons from the bypassed pay region. It is also possible to cycle between injection mode and production mode repeatedly. As can be understood, when a fluid is injected, other additives such as surfactants may also be added to the injected fluid to improve production performance. While it is not necessary to establish fluid communication between the bypassed pay region and a nearby SAGD steam chamber to produce hydrocarbons from the bypassed pay well, such communication may develop as fluids in the bypassed pay region are depleted during production from the bypassed pay well.

Some embodiments of the present invention thus may involve placement and operation of a well or wells that follow(s) the contour of the base of a subterranean reservoir, where the principal or initial recovery mechanism of hydrocarbons from the reservoir is a gravity-controlled process such as SAGD. The well or wells that follow(s) the contour of the base of the reservoir are implemented so as to access a bottom portion of the reservoir near or adjacent to the base of the formation from which hydrocarbons have not or had not been recovered in the course of operation of the prior configuration of wells under the gravity-controlled recovery process.

In some embodiments, a bypassed pay well may have a contoured well bore section that follows a contour of a depression on a contoured base of a reservoir.

In some embodiments, a bypassed pay well may be arranged to go through the lowest elevation points or regions on the contour of the base. As fluids including mobile petroleum fluids may be expected to tend to drain towards the lower elevation points and regions along the base and accumulate at these regions over time, one or more wells placed in such regions can be used to increase the overall amount of hydrocarbons that can be produced from the reservoir. Such a well generally follows the top surface contour of the base and may be placed and oriented to trace the local minimum of elevation of the top surface of the base. However, while such placement of the bypassed pay wells may be beneficial in some embodiments, such placement is not necessary in other embodiments as maximizing total recovery may need to be balanced against other technical and economical factors and considerations. For example, the overall technical and economical factors and considerations may favor the placement of the bypassed pay well(s) in another manner. The relevant factors and considerations would be understood and can be readily assessed by those skilled in the art for a given application. For example, relevant factors may include the expected distribution and quality of bitumen sand in the reservoir, the saturation profile in the reservoir, the contour profile of the base, the relative placement of existing wells or other wells to be drilled at the same operation site, the location of existing surface facilities or surface facilities that will need to be installed for other purposes, which will be shared by different wells, or the like. A factor that needs to be considered for optimal overall production is to avoid or minimize interference with hydrocarbon production from other wells such as an existing production well above the bypassed pay well.

In some embodiments of the present invention, a bypassed pay well may extend under and across another production well for producing hydrocarbons below the other production well.

In the context of the present application, various terms are used in accordance with what is understood to be the ordinary meaning of those terms.

For example, a "reservoir" refers to a subsurface formation containing one or more natural accumulations of moveable petroleum, which are generally confined by relatively impermeable rock or other geological layers of materials. A "bituminous sand", "oil sand" or "tar sand" reservoir is generally formed of strata of sand or sandstone containing petroleum. These reservoirs may be collectively referred to as hydrocarbon reservoirs herein. Typically, a reservoir formation containing recoverable hydrocarbons, referred to as the "pay", is formed between a top cap layer and a bottom base. The base may be a contoured base, i.e., the top contour of the base (at the interface between the base and the pay) having varied elevation at different locations. The base is typically formed of a layer of impermeable material such as clay or shale, with no or little movable petroleum content. A depression in a contoured base is a region where the elevation at the bottom of the depression is lower than the elevation of an adjacent region of the base. The base of the reservoir may also include a volume of water accumulated above an impermeable layer, which is often referred to as "bottom water".

"Petroleum" is a naturally occurring mixture consisting predominantly of hydrocarbons in a gaseous, liquid or solid phase. In the context of the present application, the words "petroleum" and "hydrocarbon" are used to refer to mixtures of widely varying composition. The production of petroleum from a reservoir necessarily involves the production of hydrocarbons, but is not limited to hydrocarbon production. Similarly, processes that produce hydrocarbons from a well will generally also produce petroleum fluids that are not hydrocarbons. In accordance with this usage, a process for producing petroleum or hydrocarbons is not necessarily a process that produces exclusively petroleum or hydrocarbons, respectively. "Fluids", such as petroleum fluids, include both liquids and gases.

It is common practice to segregate petroleum substances of high viscosity and density into two categories, "heavy oil" and "bitumen". For example, some sources define "heavy oil" as petroleum that has a mass density of greater than about 900 $kg/m^3$. Bitumen is sometimes described as that portion of petroleum that exists in the semi-solid or solid phase in natural deposits, with a mass density greater than about 1000 $kg/m^3$ and a viscosity greater than 10,000 centipoise (cP; or 10 Pa·s) measured at original temperature in the deposit and atmospheric pressure, on a gas-free basis. Although these terms are in common use, references to heavy oil and bitumen represent categories of convenience, and there is a continuum of properties between heavy oil and bitumen. Accordingly, references to heavy oil or bitumen herein include the continuum of such substances, and do not imply the existence of some fixed and universally recognized boundary between the two substances. In particular, the term "heavy oil" includes within its scope all "bitumen" including hydrocarbons that are present in semi-solid or solid form.

Reservoirs and other geologicl formations are often divided into zones. A "zone" in a reservoir refers to a defined volume of the reservoir, which is typically characterized by one or more physical, chemical, or geological properties that are distinct from that of a nearby or adjacent "zone" or volume of the reservoir. For example, a particular hydrocarbon formation may have an upper primary pay zone and a lower secondary pay zone separated by an impermeable barrier, where the barrier forms a base below the primary pay zone. It is conventional to position the SAGD injection and production well pairs in the primary pay zone above the base layer that separates the primary pay zone and the secondary pay zone, and it is standard practice in SAGD processes to drill production wells in the primary pay zone some distance above the base.

A "base" of a reservoir may be formed of any material that is significantly less permeable to petroleum fluids than the primary pay zone so that petroleum fluids even when mobilized will accumulate above the base and will not drain downward through the base layer at a significant rate. The base of a reservoir also means that there is no other impermeable layer between the primary pay zone of the reservoir and the base that would prevent fluid communication between the primary pay zone and the pay zone region just above the base. Some impermeable or low permeability regions may exist in the reservoir above the base if their horizontal sizes are relatively small so formation fluids can still flow around them to reach the base.

The term "follow" is used in this context according to its ordinary meanings, and in the sense that both the horizontal and vertical orientation and extension of a liquid collecting well bore section of a bypassed pay well are guided by the contour of the top surface of the base such that the well generally remains within a close distance from the base. In some embodiments, the distance between the base and a bypassed pay well may be less than about 3 m. In some embodiments, the distance between a contour section of a well and the base may be as small as that which is technically practical. Unless otherwise specified, the maximum distance between a well and a base refers to the maximum vertical distance between the base and a liquid collecting well bore section of the well. For example, for a SAGD production well, the generally horizontal section of the production well below the injection well is the liquid collecting section. Where the vertical spacing between a liquid collecting section and the base may vary, the maximum vertical spacing may be at the location of a depression on the base. When a well follows the contour of a base, the vertical distance between the base and the well may vary but only vary within a limited range, such as within 1 m, 2 m, or 3 m.

Terms such as "under", "below", and "above" are used in their ordinary meanings in the present context and refer to the relative elevation of the two referenced objects, such as two wells, or a well and a geological formation or structure. In some cases, different sections of one or both of the objects may have different elevations. The terms, "below", "under" or "above" in such cases refer to the elevation of the sections of the objects at the same location on a horizontal plane. For example, if a first well and a second well are aligned across each other (i.e., overlap at a certain location in a top plan view), and the second well is under the first well at the location of crossing (the location of overlap), then the second well is considered under the first well. Similarly, a well is considered above a base if the elevation of the well is higher than the elevation of the portion of the base that is vertically under the well.

A production well may refer to any well from which hydrocarbons can be or have been produced, and includes but is not limited to production wells in SAGD well pairs. The production well typically has a generally horizontal well bore section for collecting mobilized petroleum fluids from a reservoir. Other production wells include wells drilled according to the WEDGE WELL™ technology, infill wells, primary or secondary production wells, and may include other bypassed pay wells.

A "chamber" within a reservoir or formation is a region that is in fluid communication with a particular well or wells, such as an injection or production well. For example, in a SAGD process, a steam chamber is the region of the reservoir in fluid communication with a steam injection well, and is also the region that is subject to depletion, primarily by gravity drainage, into a production well. A chamber is thus a depleted region.

Generally, embodiments of the present invention may relate to methods or processes for recovery of viscous hydrocarbons from a subterranean reservoir of hydrocarbons. The subterranean reservoir may have been penetrated by wells that have or had been operating under a gravity-controlled recovery process, such as SAGD. In the present context, and consistent with current practice of the art, such as field operation of SAGD processes, reference to a gravity-controlled recovery process implies a process whose flow mechanisms are predominantly gravity-controlled and whose techniques of operation are largely oriented toward ultimately maximizing the influence of gravity control because of its inherent efficiency.

In an embodiment of the present invention, a bypassed pay well may be utilized in an arrangement as illustrated in FIG. 1. A reservoir 100 is formed above a base 102 and below a top 104. Reservoir 100 contains bituminous sand and viscous hydrocarbons producible by SAGD. Base 102 may be impermeable to petroleum fluids, and thus hold mobile petroleum fluids above base 102 in reservoir 100. A depression 102A is present on the top contour of base 102. Depression 102A of base 102 may define a valley or a basin above base 102.

As depicted, a pair of SAGD wells including an injection well 106 and a production well 108 extends substantially horizontally in reservoir 100 above base 102, for producing hydrocarbons from reservoir 100. For practical and economical reasons, wells 106 and 108 extend substantially linearly with no or a small vertical inclination, and are generally parallel to each other. As is typical, injection well 106 may be vertically spaced from production well 108, such as at a distance of about 5 m. The distance between the injection well and the production well in a SAGD well pair may vary and may be selected to optimize the SAGD operation performance, as can be understood by those skilled in the art. In some embodiments, the horizontal sections of wells 106 and 108 may have a length of about 800 m. In other embodiments, the length may be varied as can be understood and selected by those skilled in the art.

The distance between production well 108 and the bottom of depression 102A is more than about 1 m, such as about 4 to about 5 m or from about 5 to about 8 m, depending on the depth of the depression and other factors for positioning production well 108 known to those skilled in the art. Even though base 102 is contoured, i.e., the top surface of base 102 varies in elevation, it is typically more economical to limit the elevation variation of the horizontal section of production well 108 (and injection well 106) to be within about 5 m when the distance between the production and injection wells 106 and 108 is about 5 m. Therefore, it is typical that SAGD wells do not closely follow the contour of the reservoir base, especially when the base is contoured. In particular, production well 108 does not bend downward to follow the contour of a depression, such as depression 102A, on base 102.

A bypassed pay well 110 is also provided, which is aligned across wells 106 and 108 and extends in the region 112 between base 102 and production well 108. As can be seen, bypassed pay well 110 follows the contour of depression 102A of base 102. The distance between bypassed pay well 110 and base 102 may be from 0 to about 2 m, or up to about 3 m. In selected embodiments, bypassed pay well 110 may extend over the lowest region in depression 102A, as depicted in FIG. 1.

Wells 106 and 108 may be configured and completed according to any suitable techniques for configuring and completing horizontal in situ wells known to those skilled in the art. Bypassed pay well 110 may be configured and completed as a production well according to known techniques. However, in at least some embodiments, the section of bypassed pay well 110 that is directly under production well 108 may be shielded or blanked to prevent collection of fluids from reservoir 100 through this section, in order to avoid or limit interference with the operation of production well 108.

As production well 108 is above region 112, hydrocarbons in region 112 are not producible from production well 108. Thus, region 112 is sometimes referred to as the "bypassed pay", as it contains producible pay that has been or will be bypassed by the production wells above.

Typically, production wells in SAGD processes are spaced from the base but at only a limited distance. For example, the distance from the bottom of depression 102A to production well 108 may be about 5 to 15 m. Thus, it can be expected that heat will be conducted from the steam chamber above to the bypassed pay region 112, and the hydrocarbons in region 112 will be sufficiently mobilised, after a period of SAGD operation to produce hydrocarbons from production well 108. Field results indicate that temperatures near wells drilled according to the WEDGE WELL™ technology, which are typically at about the same depth as, but laterally spaced by about 50 m from, adjacent production wells in SAGD well pairs in a SAGD operation, can reach above 80° C., even up to about 100° C., when the steam chamber temperature is maintained at about 230° C. At temperatures of about 80° C., the hydrocarbons or petroleum in region 112 can be expected to become sufficiently mobilized for economical production through bypassed pay well 110. Further, petroleum liquids mobilized in other higher regions in reservoir 100 may also flow towards the lower regions such as region 112 over time and accumulate in region 112.

Conveniently, the mobilized hydrocarbons in region 112 may be produced through bypassed pay well 110.

Thus, in operation, wells 106 and 108 may be initially used to produce hydrocarbons from reservoir 100 according to a normal SAGD process and any suitable variation thereof that may be implemented for the given reservoir.

After a period of SAGD production, such as when the production rate has reduced, hydrocarbon production from bypassed pay well 110 may commence.

The operations of wells 106, 108 and 110 may be carried out according to known techniques for operating SAGD wells or wells in other gravity-controlled recovery processes.

Figure 2:
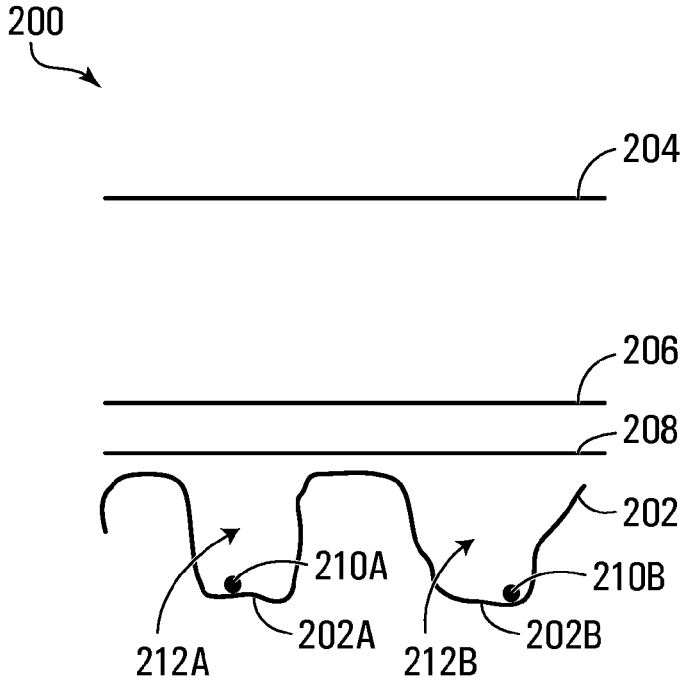

In another embodiment of the present invention, two or more bypassed pay wells may be utilized as illustrated in FIG. 2. A reservoir 200 is formed above a base 202 and below a top 204. Reservoir 200 contains producible hydrocarbons as in reservoir 100. Two depressions 202A and 202B are present on the top contour of base 202.

As in FIG. 1, a SAGD well pair including an injection well 206 and a production well 208 may be provided to extend substantially horizontally in reservoir 200 above base 202, for producing hydrocarbons from reservoir 200, as shown in FIG. 2. However, a bypassed pay well 210A is provided in a depression region 212A above a depression 202A, and a bypassed pay well 210B is provided in a depression region 212B above a depression 202B. Both bypassed pay wells 210A, 210B are aligned across wells 206, 208 and extend between base 202 and production well 208.

Wells 206, 208 and 210A and 210B may be configured and operated as wells 106, 108 and 110 respectively.

Figure 3A:
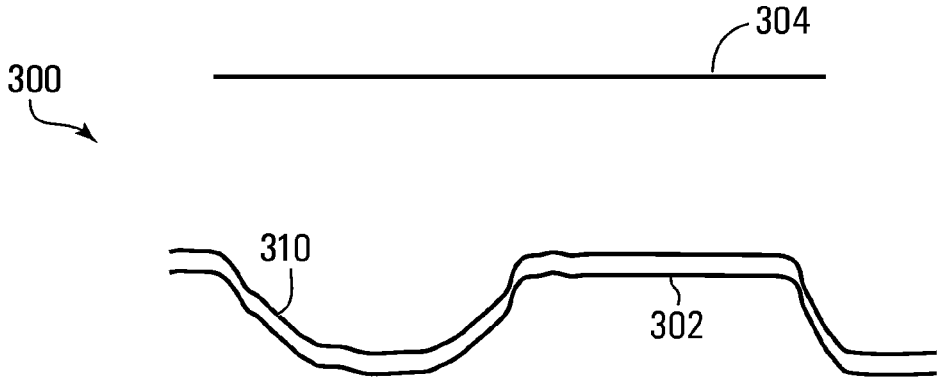
FIG. 3A is a schematic elevation section view of a well bore section that follows a contoured base of a reservoir, according to a selected embodiment of the present invention.

A further embodiment of the present invention relates to a well that has a contour section 310 which follows a contour of a reservoir base 302, as illustrated in FIG. 3A. As depicted in FIG. 3A, a reservoir 300 is formed above a base 302, and below a cap layer 304. Reservoir 300 contains bituminous sand and viscous hydrocarbons producible by SAGD. Base 302 is impermeable to petroleum fluids, and thus holds mobile petroleum fluids above base 302.

The term "follow" in the present context refers to the general conformity of the extension of contour section 310 with the top contour of base 302, such that the distance between base 302 and contour section 310 is less than about 2 or 3 m. The distance between contour section 310 and base 302 may be generally from 0 to about 2 m. However, depending on various conditions and considerations for a given reservoir formation and base structure, some sections of the well may be distanced from the base 302 by more than 3 m. In particular, contour section 310 includes a contoured well bore section that follows the contour of a depression on contoured base 302. For ease of reference, the well that has contour section 310 is also referred to as well 310.

Figure 3B:
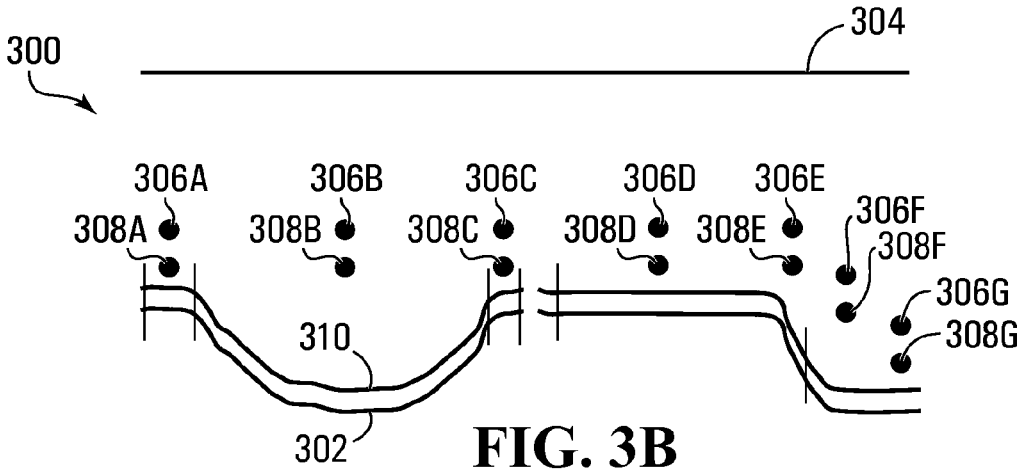
FIG. 3B is a schematic elevation section view of an arrangement of wells in a reservoir including the well shown in FIG. 3A, according to a selected embodiment of the present invention.
Figure 3C:
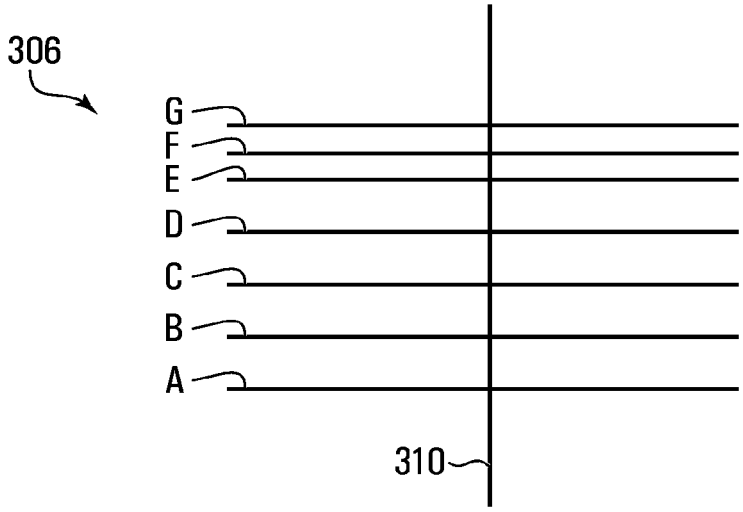
FIG. 3C is a schematic top plan view of the arrangement of FIG. 3; production wells and a bypassed pay well, according to a selected embodiment of the present invention.

In a selected embodiment, contour section 310 may extend across and under a plurality of production wells in a SAGD process as illustrated in FIGS. 3B and 3C.

As depicted, injection wells 306A, 306B, 306C, 306D, 306E, 306F, 306G (also individually or collectively referred to as injection well(s) 306) and production wells 308A, 308B, 308C, 308D, 308E, 308F, 308G (also individually or collectively referred to as production well(s) 308) may be positioned in the reservoir 300 above the base 302. For practical and economical reasons, wells 306, 308 in a given reservoir region may be arranged substantially parallel to one another and are substantially horizontal. In each well pair, the injection well 306 is vertically spaced from the corresponding production well 308 below, such as at a distance of from about 4 to about 8 m, or about 5 m. The distance between each production well 308 and base 302 is more than about 1 m, such as more than about 3 m and may be about 4 to about 5 m or about 5 to about 8 m. As discussed elsewhere, production wells 308 may be positioned and oriented to optimize the performance of the SAGD process, and as a result they typically do not follow the contour of the reservoir base, as depicted. The horizontal distances between different SAGD well pairs (denoted by A, B, C, D, E, F, G in FIGS. 3B and 3C) may be selected to optimize the overall production efficiency and performance. For example, in some cases, the horizontal distance between two adjacent well pairs may be about 50 to about 100 m or even greater depending on the geological contours.

As depicted in FIG. 3B, Contour section 310 extends across and under production wells 308 between base 302 and production wells 308.

Hydrocarbons may be produced from reservoir 300 from production wells 308 according to a SAGD process, as can be understood by those skilled in the art. Briefly, steam may be injected into reservoir 300 through injection wells 306 to reduce the viscosity of viscous petroleum in reservoir 300 and mobilise the petroleum. The mobilised petroleum and condensed steam will drain downward under gravity and can thus be produced from production wells 308. Steam chambers (not shown) are formed due to depletion of fluids from regions of the reservoir 300. A steam chamber typically expands upwardly and laterally from the corresponding injection well 306 (such as well 306A). Viscous hydrocarbons in reservoir 300 are heated and mobilised, especially at the margins of the steam chamber where the steam condenses and heats a layer of viscous hydrocarbons by thermal conduction. The mobilised hydrocarbons (and aqueous condensate) drain under the effects of gravity towards the bottom of the steam chamber, where the corresponding production well 308 (such as well 308A) is located. The mobilised hydrocarbons are collected and produced from the production well 308 (such as well 308A).

After a certain period of SAGD operation, petroleum such as bitumen in regions of reservoir 300 below production wells 308 near base 302 will also become producible due to heat conducted from steam chamber(s) above. However, as the petroleum fluids in these regions are below the production wells 308, they cannot be produced through production wells 308. As noted above, these regions may be referred to as "bypassed pay".

Conveniently, well 310 may be used to produce hydrocarbons from the bypassed pay below production wells 308, as well 310 is positioned closer to base 302 and may follow the contour of base 302. For this purpose, well 310 may be drilled to follow a direction and have a length that would provide the optimal economical return under the constraints of the given reservoir and existing facilities at the site. Production from well 310 may be commenced at a later stage of the SAGD production from production wells 308, or may be carried out after termination of production from production wells 308. In some embodiments, it is not necessary to provide additional heating directly to the bypassed pay region during production from well 310. However, when it is economical and practical, additional heat may be provided to a bypassed pay region directly such as by steam injection, to improve production rate. For example, steam or a solvent may be injected through well 310 before production from well 310.

As depicted in FIG. 3C, well 310 is aligned across production wells 308 generally perpendicularly (at an angle of about 90° when viewed down from above).

Figure 3D:
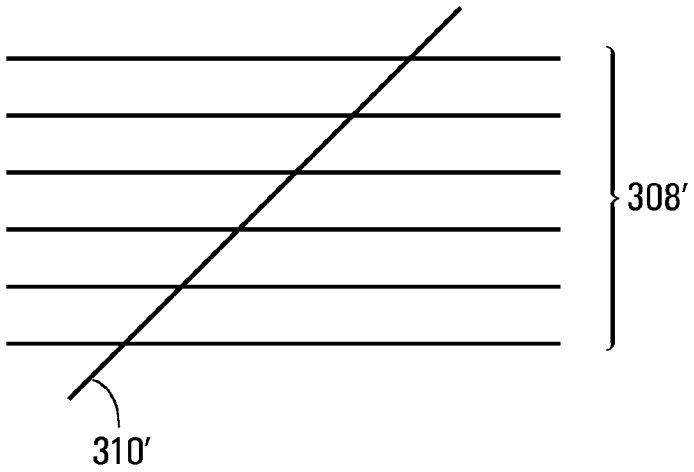
FIG. 3D is a schematic top plan view of an alternative arrangement of wells, according to a selected embodiment of the present invention.

However, in some embodiments, a bypassed pay well may be parallel to or aligned across one or more production wells at an inclined or oblique angle (0°<<90°), as illustrated by productions wells 308' and well 310' in FIG. 3D, which shows a schematic top plan view of a possible well arrangement. As well as 310 in FIGS. 3B and 3C, well 310' extends under each of production wells 308' between the reservoir base and production wells 308'.

In some embodiments, an underlying production well, such as well 310 and 310' may extend generally linearly or straight in a top plan view, as illustrated in FIGS. 3C and 3D (but may vary in elevation as discussed above). In other embodiments, an underlying production well may be curved, for example, to follow a depression, such as a winding valley, on the base. As a result, the relative alignment angles between an underlying production well and the overlying production wells may vary.

Figure 4:
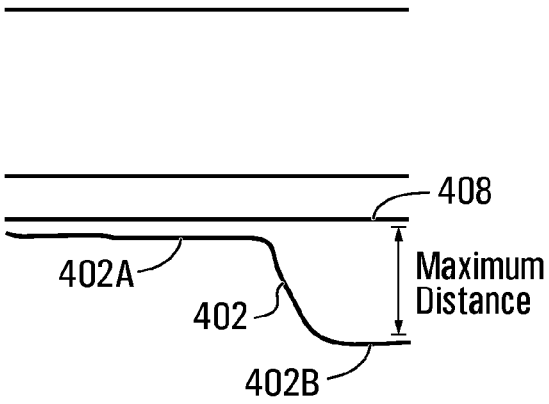
FIG. 4 is a schematic elevation section view of a SAGD well pair in a reservoir.
Figure 5:
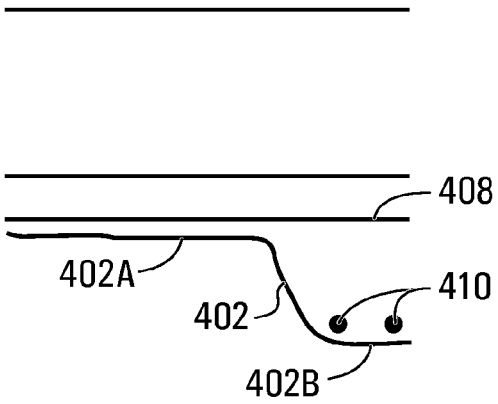
FIG. 5 is a schematic elevation section view of the SAGD well pair in the reservoir of FIG. 4, provided with two underlying wells, according to a selected embodiment of the present invention.

Another embodiment is illustrated in FIGS. 4 and 5. As shown, in this case the base 402 of a hydrocarbon reservoir has significant elevation changes. As depicted, base 402 has an elevated portion 402A and a depression portion 402B. The change in elevation may be due to various base contour structures that are possible during natural geological formation. For example, depression portion 402B may be a depression on base 402, which may define a valley or a basin above base 402. Depression portion 402B may also be formed due to an inclined slope or a step in the contour of base 402. A SAGD production well 408 may be provided which is close to the elevated portion 402A of base 402 but is distanced from the depression portion 402B of base 402, to limit the curvature and inclination of production well 408. When depression portion 402B has a sufficiently wide flat bottom, two or more bypassed pay wells 410 may be provided side by side as shown in FIG. 5.

The extension and horizontal orientation of wells 110, 210, 310, 410, may be selected to optimize efficiency, performance and economical profit-to-cost ratio. For example, when other factors are equal, positioning a bypassed pay well over the lowest elevation regions on the contour of base 102 may maximize the amount of hydrocarbons that can be produced over long run, as the mobilised petroleum fluids tend to accumulate at the lowest regions on the base due to gravity. Another factor that may affect overall production efficiency and performance is that overlap of a bypassed pay well with an overlying production well can reduce the performance of production from that overlying production well, when petroleum fluids that could have been produced from the overlying production well are, instead, being produced from the underlying bypassed pay well. Thus, an underlying well may be aligned across each overlying production well to reduce overlap with the overlying production well and limit the interference with its production performance.

Further, the well bore section of an underlying well under an overlying production well at the cross point may be shielded (such as by a shield sleeve or by having a liner with a blanked section at the cross point) to prevent drainage of petroleum fluids or other fluids into the underlying well through the shielded section. Such shield may be provided by a blank sleeve, or by a slotted liner with a section without slots or slits for receiving fluids.

Figure 6:
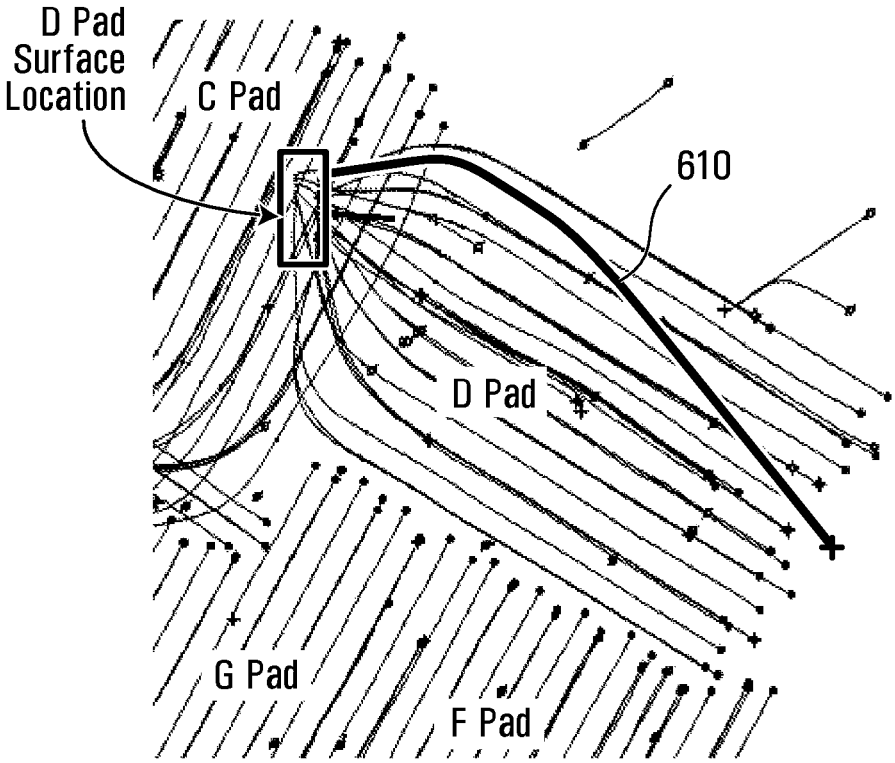
FIGS. 6, 7 and 8 are schematic top plan views of arrangements of wells, according to selected embodiments of the present invention.

In a further embodiment, an underlying production well 610 may be aligned across overlying production and injection wells (shown by un-numbered lines) as illustrated in FIG. 6, which shows actual arrangements of SAGD well pairs at a SAGD recovery site that has been in operation for 10 years. The orientation and profile of well 610 are selected to optimize economical return from producing hydrocarbons from well 610 based on available geological data and the existing facilities at the site. For example, the well head of well 610 may be located close to other well heads of wells on the same pad.

Figure 7:
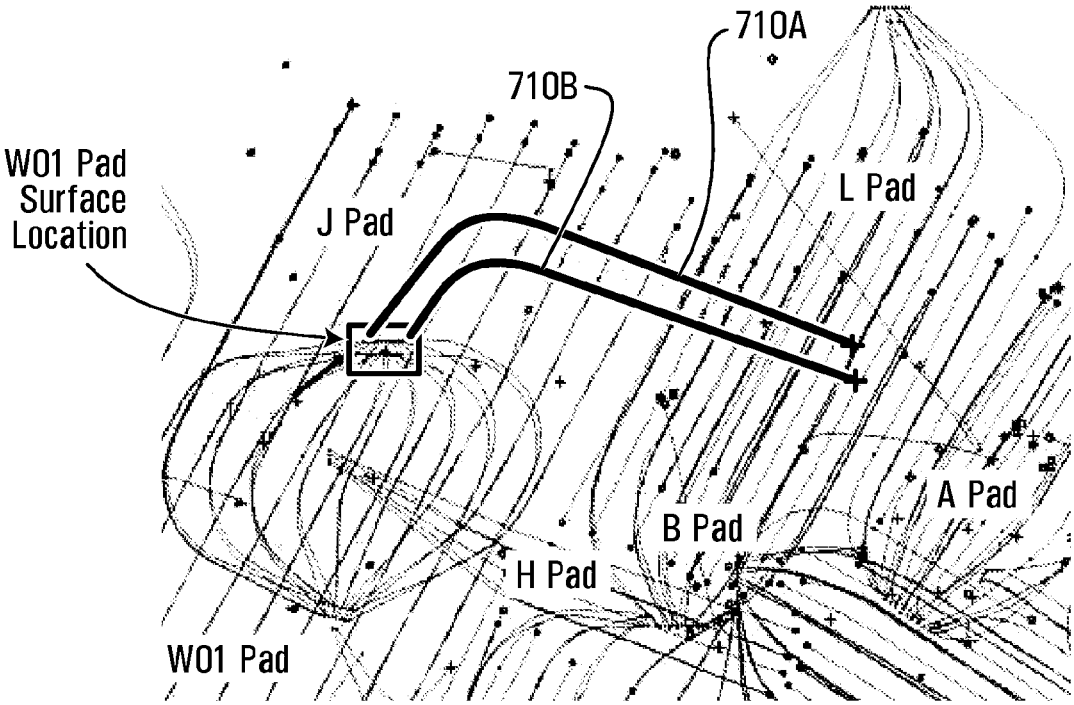

An alternative arrangement of wells is illustrated in FIG. 7, where two underlying wells 710A and 710B may be provided to extend under overlying production and injection wells (shown by un-numbered lines), which illustrates an actual arrangement of SAGD well pairs at a SAGD recovery site that has been in operation for 10 years. The orientation and profile of wells 710A and 710B are selected to optimize the overall economical return from producing hydrocarbons from both wells 710A and 710B based on available geological data and the existing facilities at the site.

Figure 8:
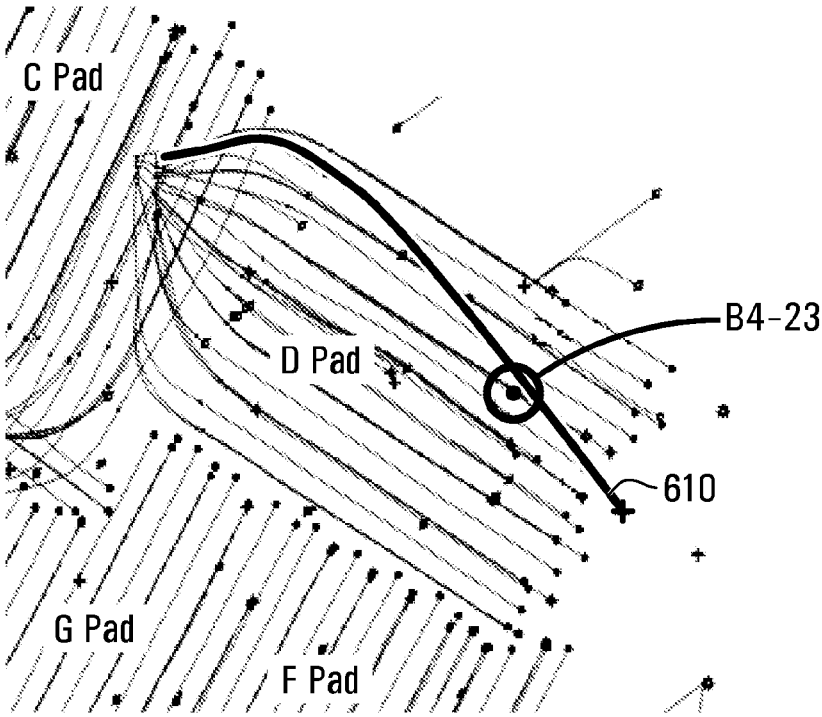
Figure 9:
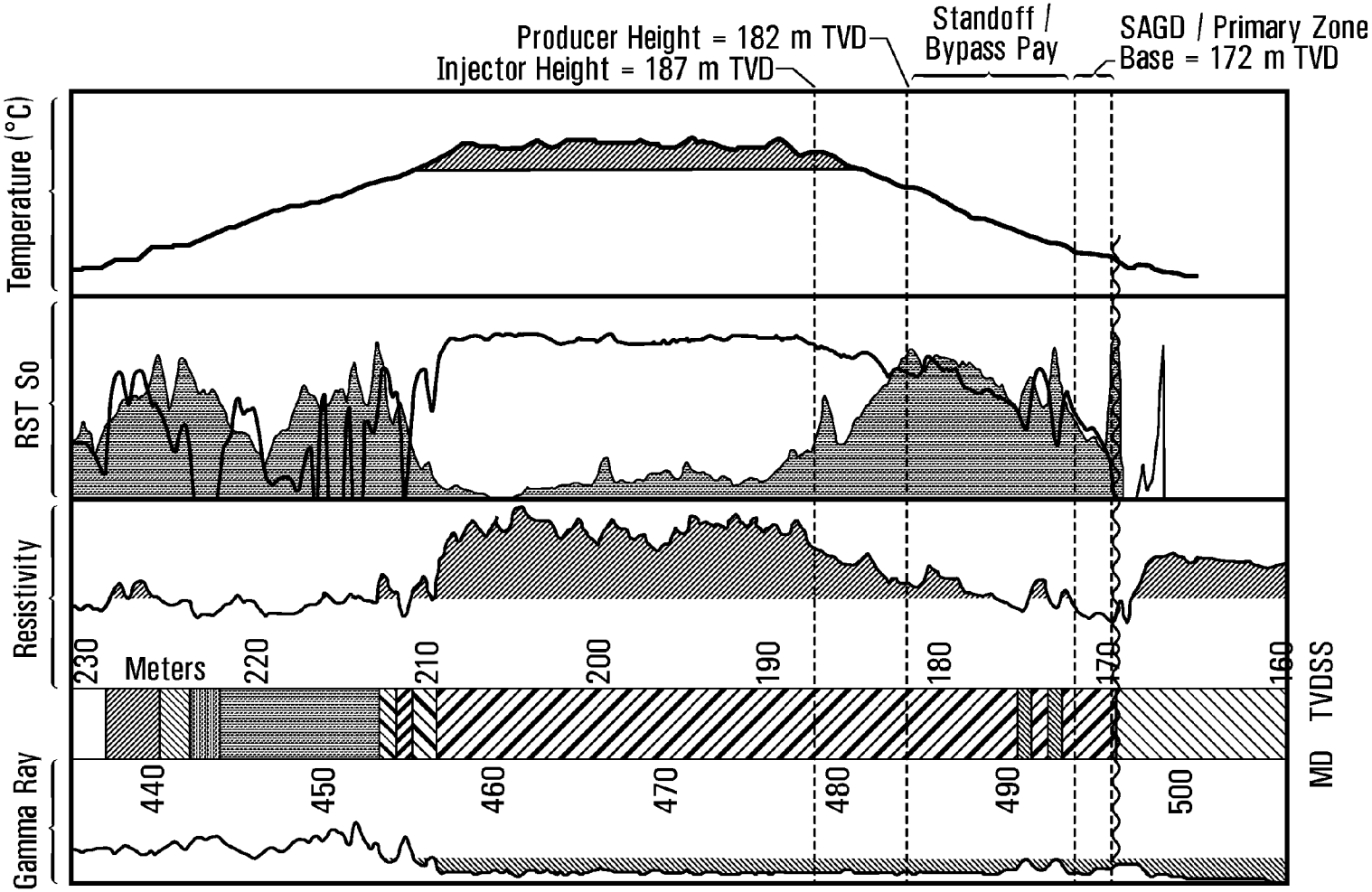
FIGS. 9 and 10 are data graphs showing geological data used for positioning the wells in FIGS. 6, 7 and 8.
Figure 10:
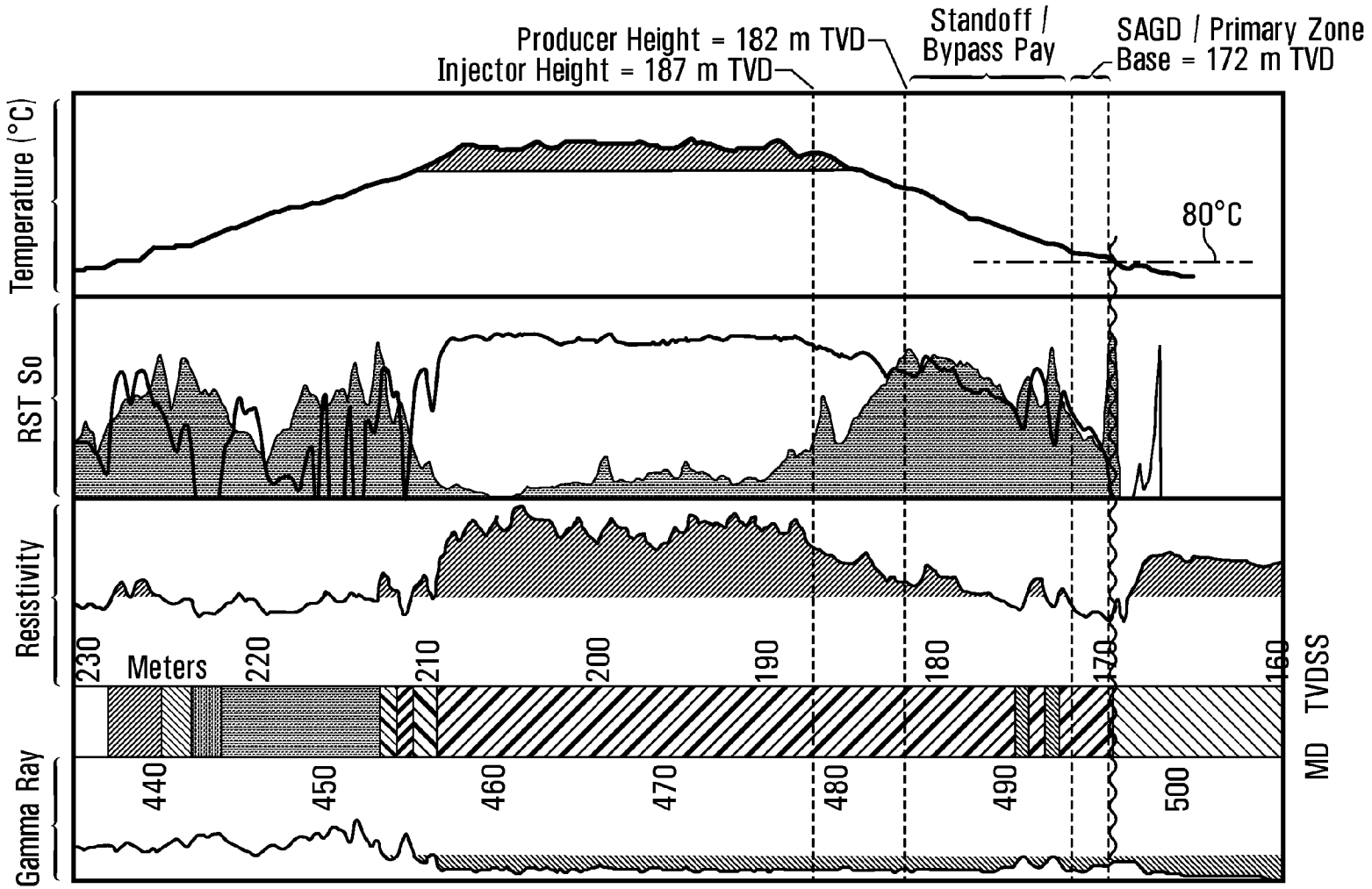
Figure 11:
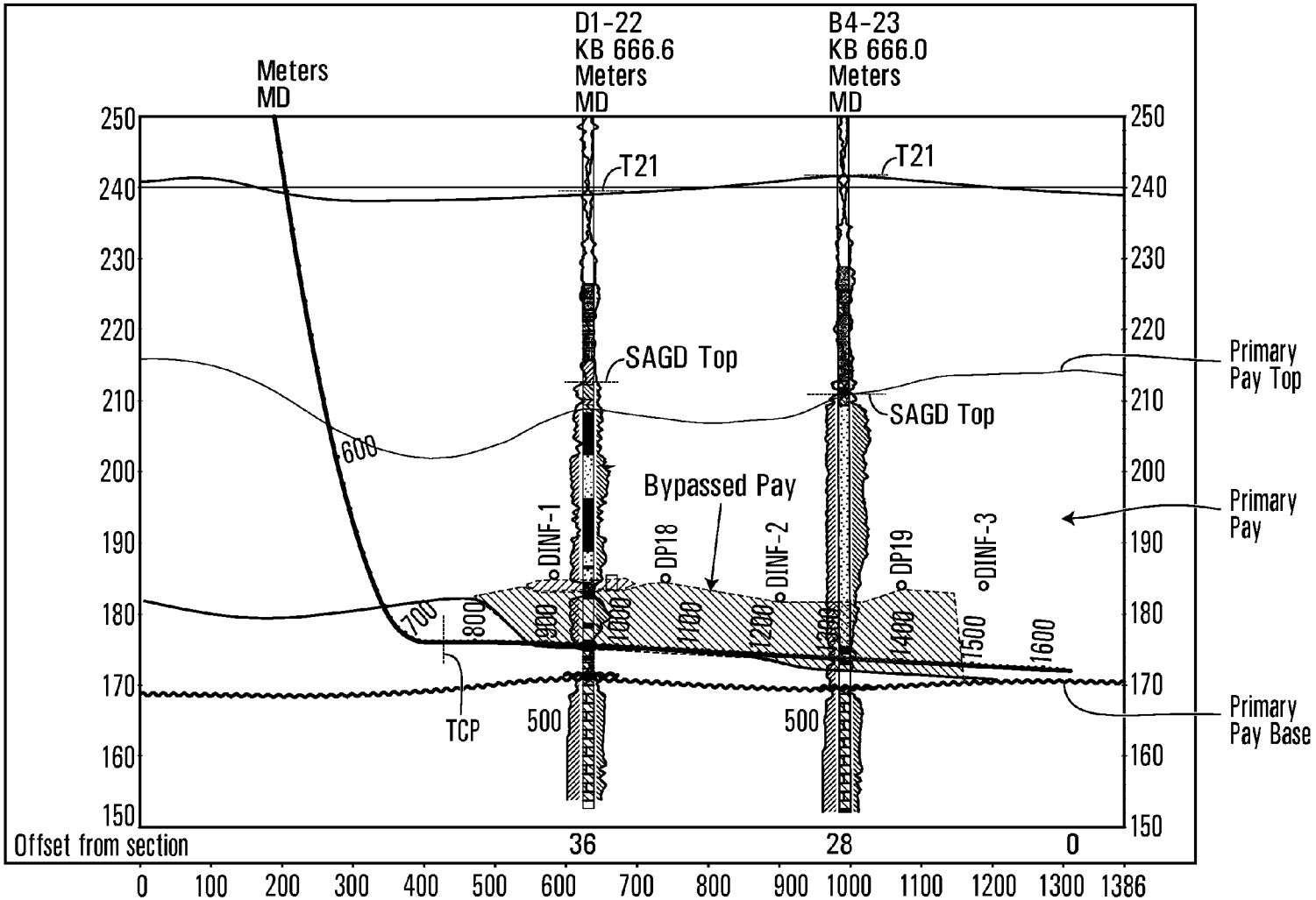
FIGS. 11, 12 and 13 are data graphs showing elevation sectional profiles of wells in FIGS. 6 and 7 in relation to reservoir formation structure.
Figure 12:
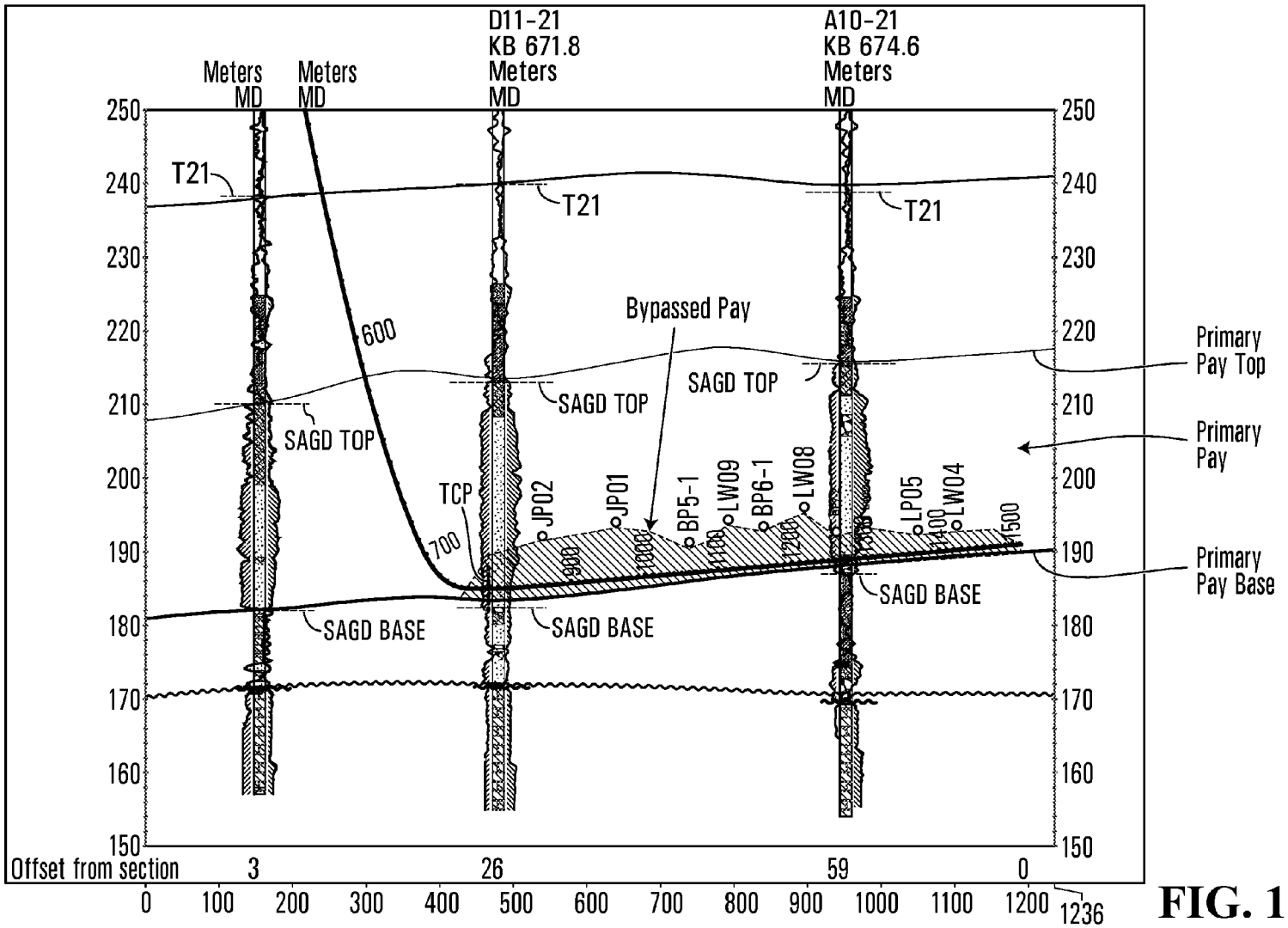
Figure 13:
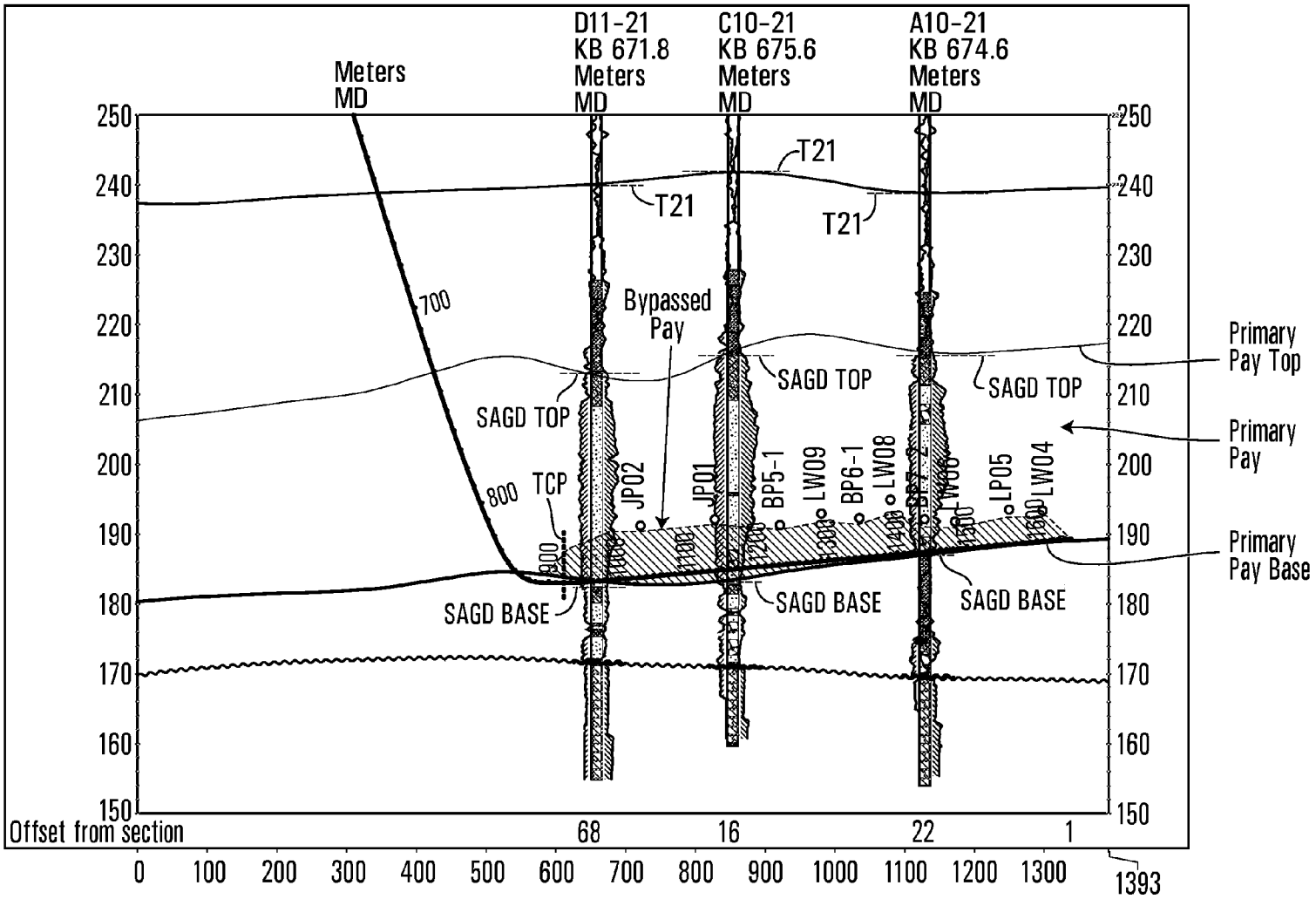

Some representative geological data used for selecting the positions of wells 610, and 710A, 710B, which were obtained from an observation well at a location shown in FIG. 8, are shown in FIGS. 9 and 10. The proposed profiles of the underlying wells 610, and 710A, 710B are shown in FIGS. 11, 12 and 13 in comparison with geological data. The oil saturation (RST So) logs in FIG. 9 indicate that there likely was oil in the bypassed pay zone below the production well. The temperature log in FIG. 10 shows that the oil in this bypassed pay zone had been heated to a temperature between about 80 to about 100° C. and had been mobilized to be able to flow. As can be seen, the underlying wells 610, and 710A, 710B were above and generally follow the base of the primary pay zone. The wells may be drilled from existing surface locations selected to minimize environmental footprint and to simplify accessibility for mechanical tie-in of the wells. In FIGS. 11 and 12, different wells located at different well pads shown in FIGS. 6, 7 and 8 are labeled as BP5-1, BP6-1, BP7-2, DINF-2, DINF-3, DP18, DP19, JP01, JP02, LP05, LW04, LW06, LW08, and LW09 for identification purpose; and "T21" indicates the T21 surface.

Channeling above the Beaverhill Lake carbonates resulted in the deposition of the Lower McMurray unit. In the project area this unit is typically 5 to 15 m thick and consists of sands and flood plain mudstones that vary in thickness and lateral extent. In some local areas the floodplain mudstones may be absent due to non-deposition, or deep down-cutting and erosion from the Middle McMurray channel.

The main existing SAGD well pairs are placed above the Lower McMurray mudstones, and within the thickest continuous pay to avoid vertical permeability barriers. In this case, bypassed pay can occur in areas where the base of the SAGD reservoir is highly variable due to inconsistencies in the Lower McMurray mudstone surface. This results in "stand-off" between the mapped SAGD Base and the placement depth of the producer wells. Hydrocarbons in the bypassed pay in the stand-off region may be produced by the proposed wells 610, 710A, 710B or other contour or underlying wells.

Reservoir saturations in the project area were originally 86% on average. Variations in So (oil saturation) can occur with the presence of a transition zone, which is defined as a zone of reduced oil saturation. Transition zones are identified using a 70% oil saturation cut off (30% water saturation), and most transition zones range from 50 to 70% So.

A dual well SAGD recovery process was used to produce bitumen from the McMurray Formation. The reservoir at Foster Creek has been shown to be amenable to SAGD. The SAGD process at Foster Greek utilizes dual horizontal well pairs that are drilled in parallel with approximately 5 m of vertical separation. The lower production well is drilled horizontally and near the bottom of the primary pay zone of the reservoir. Steam is injected in the upper injection well. Steam injection generates a high-temperature steam chamber which heats the surrounding bitumen, allowing it to drain by gravity into the lower well (producer). The current commercial SAGD process at Foster Creek involves four phases of operations which include start-up, ramp-up, conventional SAGD and blowdown.

The Foster Creek SAGD Project produces from the McMurray Formation, which consists of a fluvio-estuarine channel system. In order for SAGD well pairs to function successfully, the SAGD producer and injector were drilled with a continuous vertical permeable sand of approximately 5 m between them to drain the bitumen resource. This requirement sometimes leaves stranded bypassed pay below the producer and above the base of the primary pay zone, as can be observed on cross sections from the D Pad B4-23 observation well shown in FIG. 9.

The bypassed pay wells 610, 710A, 710B are expected to take advantage of conductive heating from the overlying SAGD well pairs. This conductive heating is higher closer to the SAGD producer where the SAGD steam chamber is closest and decreases with distance to the base of the SAGD pay. The temperature gradient is evident on observation wells in which fiber strings were used to record the temperature of the reservoir. The D Pad B4-23 observation well is located 25 m from the DP19 producer well and 25 m from the proposed D Pad bypassed Pay well 610 and is illustrated in FIG. 8. The temperature profile from this observation well, shown in FIG. 10, indicates that the temperature of the reservoir below the operating SAGD well pairs in the main SAGD zones, at the depth at which the bypassed pay wells is planned, is approximately 100° C. To benefit from this heated zone the bypassed pay wells should be in relatively close proximity to existing pairs to produce this heated bitumen that would otherwise be inaccessible.

Proposed well 610 is within the bypassed pay directly underlying and crossing some D Pad producers and wells drilled according to the WEDGE WELL™ technology, and proposed wells 710A, 710B are directly underlying and crossing the B/L Pad producers and wells drilled according to the WEDGE WELL™ technology.

Well 610 is to be drilled beneath five pre-existing SAGD well pairs as shown in FIG. 6. There is a trend of primary bypassed pay channeling across the pad that can be accessed through well 610 with the well profile shown in FIG. 11. Wells 710A and 710B will be drilled above the LP10 pay well and across the main B/L Pads. Wells 710A and 710B will be drilled 10 m above the LP10 well and 5-8 m below all operating SAGD wells on the B/L Pad. The proposed profiles of wells 710A and 710B are shown in FIGS. 12 and 13. Wells 710A and 710B are to be drilled under and across 7 SAGD well pairs and 4 other wells.

An additional steam injection well is not expected to be needed to support production from wells 610, 710A, and 710B. By drilling beneath the SAGD well producers and wells drilled according to the WEDGE WELL™ technology, it may be possible to optimize the production of bypassed pay oil from conductive heat exposure and increase overall resource recovery.

In selected embodiments, a bypassed pay well may extend across and under an existing production well and it is not necessary that the bypassed pay well follows closely the contour of the base in all cases. Even without following the contour, some additional hydrocarbons may still be recovered from the bypassed pay well.

In some embodiments, a multilateral well may be used as a production well, which can be either an overlying production well or an underlying bypassed pay well. A multilateral well has a branched well bore where lateral branches of well bores extend from a common well bore section that extends from the earth's surface. Selected arrangements of such wells are illustrated in FIGS. 14, 15, 16 and 17.

Figure 14:
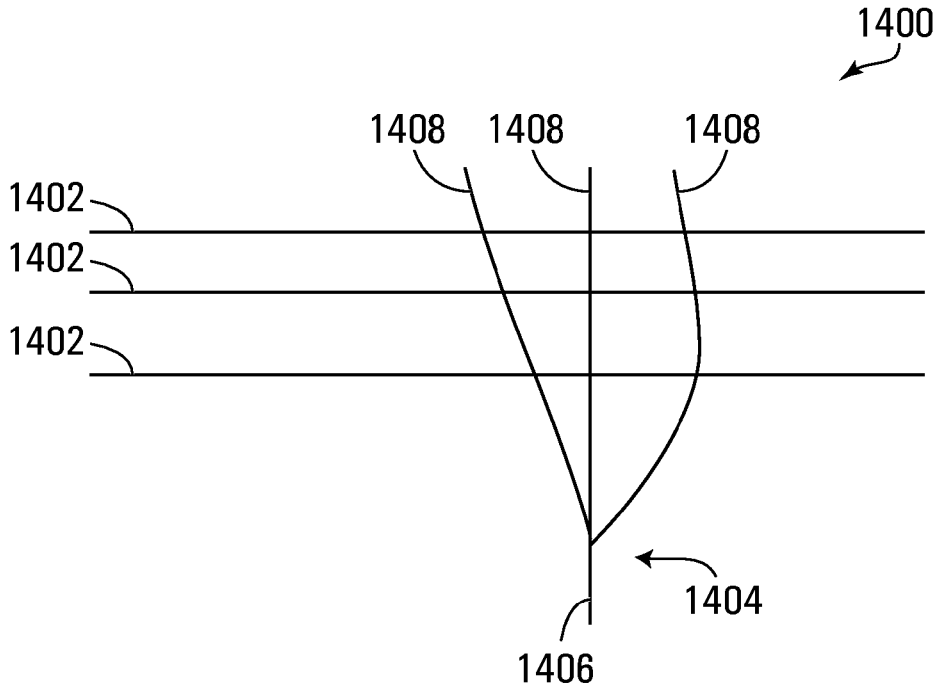
FIGS. 14, 15, 16 and 17 are schematic top plan views of different arrangements of wells, according to selected embodiments of the present invention.

In FIG. 14, a well arrangement 1400 includes overlying production wells 1402 and an underlying bypassed pay well 1404, which includes a branched well bore. The branched well bore of well 1404 includes a surface section 1406 which extends downward from the surface, and three lateral branches of well bore sections 1408. Each lateral branch section 1408 extends across and under production wells 1402, but in different lateral directions. While only three lateral branch sections are shown in FIG. 14, it should be understood that the number of branches in a multilateral well may vary. The number of branches and their directions and trajectories may be selected with a view to optimize hydrocarbon recovery at a reduced or minimum cost.

Figure 15:
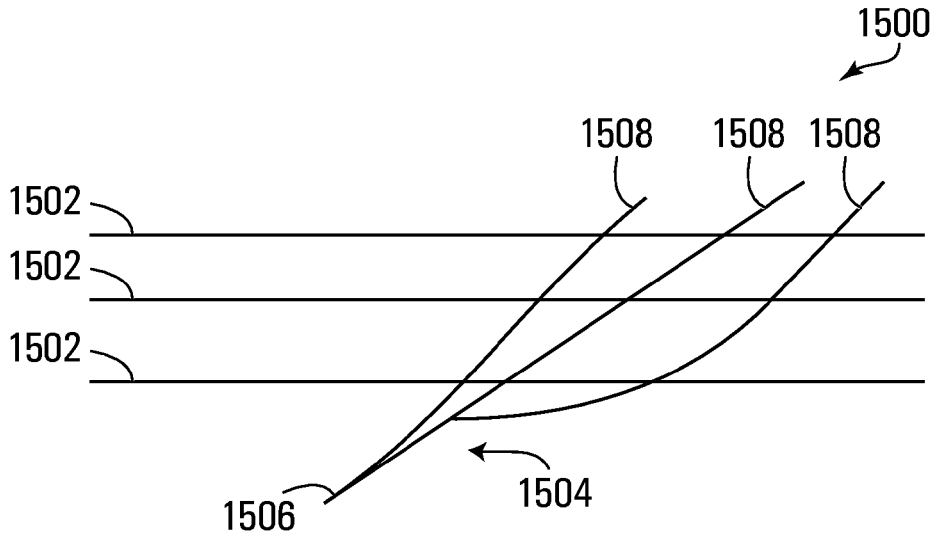

In FIG. 15, a well arrangement 1500 includes overlying production wells 1502 and an underlying bypassed pay well 1504, which includes a branched well bore. The branched well bore of well 1504 includes a surface section 1506 which extends downward from the surface, and three lateral branches of well bore sections 1508. Each lateral branch section 1508 extends across and under production wells 1502, but in different lateral directions. As compared to FIG. 14, the cross angles of the wells are different in FIG. 15, which may also vary to be larger or smaller depending on the particular application and reservoir formation. Further, as illustrated in FIGS. 14 and 15, the branched sections of a branched well bore may branch from the same location (as depicted in FIG. 14) or from different locations (as depicted in FIG. 15).

Figure 16:
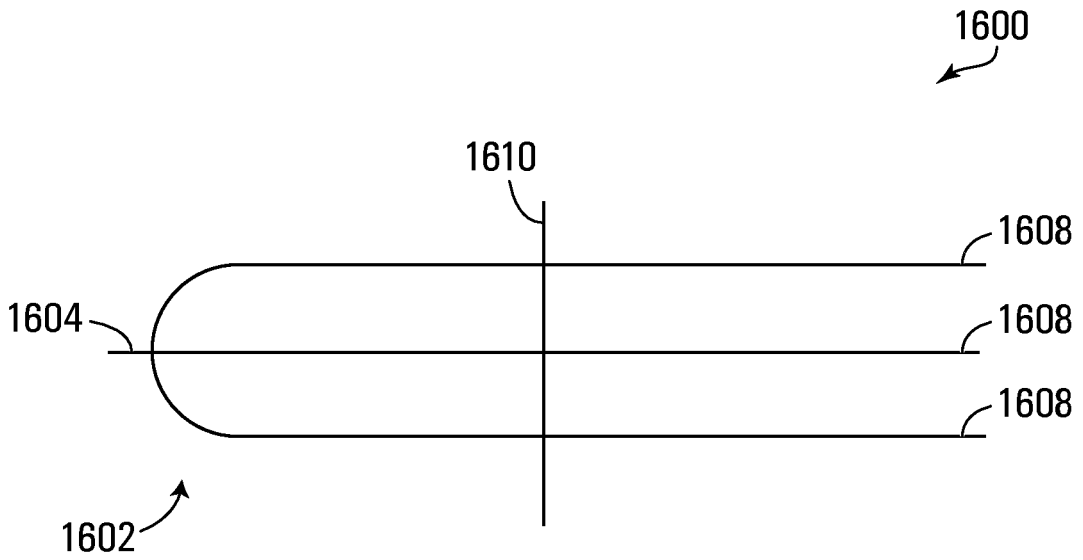

In FIG. 16, a well arrangement 1600 includes a multilateral overlying production well 1602 and an underlying bypassed pay well 1610. Production well 1602 includes a branched well bore, which has a surface section 1604 and three lateral branches of well bore sections 1608. Bypassed pay well 1610 extends across and under each lateral branch section 1608 of production well 1602.

Figure 17:
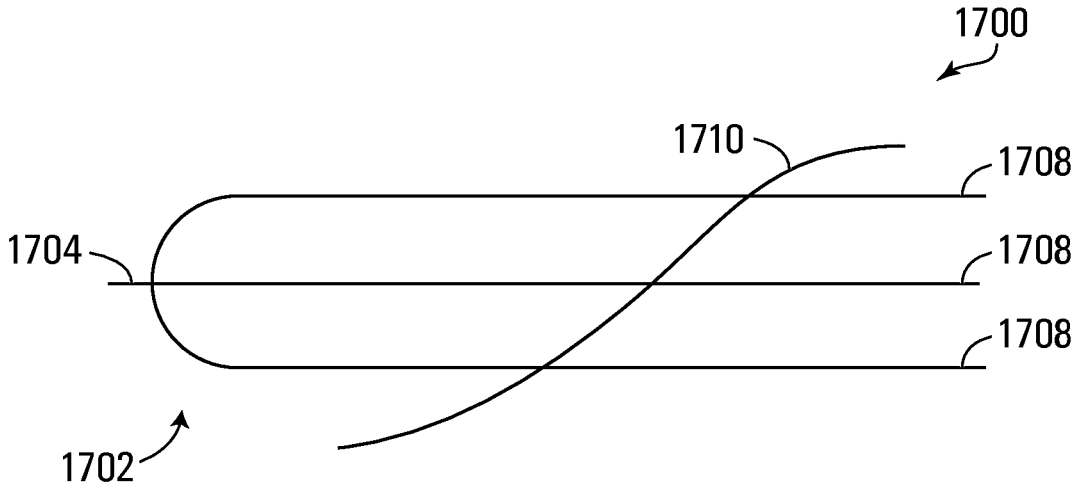

In FIG. 17, a well arrangement 1700 includes a multilateral overlying production well 1702 and an underlying bypassed pay well 1710. Production well 1702 includes a branched well bore, which has a surface section 1704 and three lateral branches of well bore sections 1708. Bypassed pay well 1710 extends across and under each lateral branch section 1708 of production well 1702. As compared to FIG. 16, the cross angles of the wells are different in FIG. 17, which may also vary to be larger or smaller depending on the particular application and reservoir formation. Further, as illustrated in the figures, an underlying bypassed pay well may have a relatively straight or curved well bore section.

Figure 18:
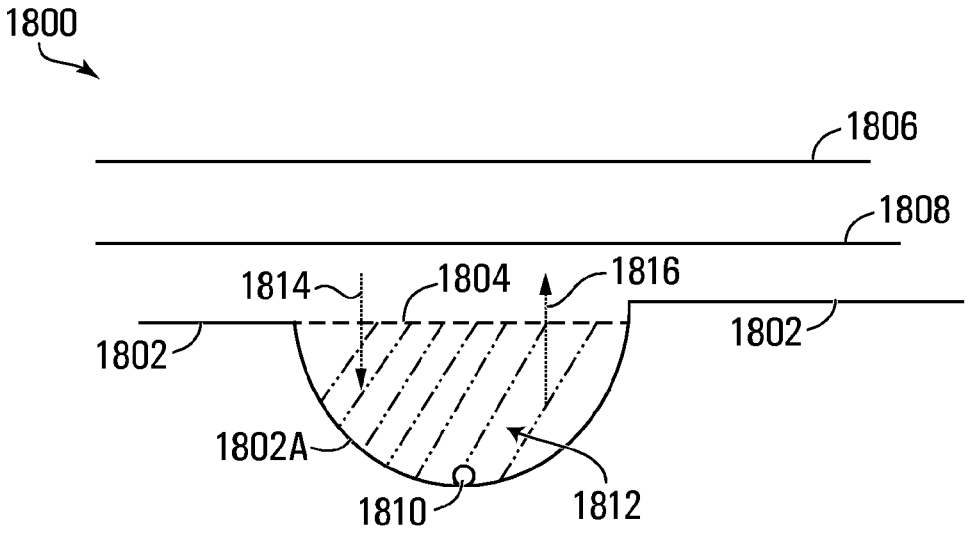
FIGS. 18, 19, 20 and 21 are schematic elevation section views of different arrangements of wells, according to selected embodiments of the present invention.

FIG. 18 illustrates a further embodiment, wherein a bypassed pay well 1810 penetrates a water-rich region 1812 above a depression 1802A on a reservoir base 1802. As depicted, a well arrangement 1800 includes a SAGD pair injection well 1806 and production well 1808, which are vertically spaced from base 1802 and the interface 1804 between water-rich region 1812 and the pay region (1804 is also referred to as the water-oil interface). Bypassed pay well 1810 extends across and under production well 1808 and penetrates water-rich region 1812. Water-rich region 1812 may be a volume of water (sometimes referred to as bottom water) or may be a region which is rich in water content and initially poor in oil content. However, due to SAGD operation using injection well 1806 and production well 1808, bitumen above the oil-water interface 1804 may become mobile and may sink to the bottom of depression 1802A, as indicated by arrow 1814. At the same time, water may be pushed upwards, as indicated by arrow 1816. Conveniently, bypassed pay well 1810 may be used to produce the hydrocarbons in the sunk bitumen from the bottom of depression 1802A.

Figure 19:
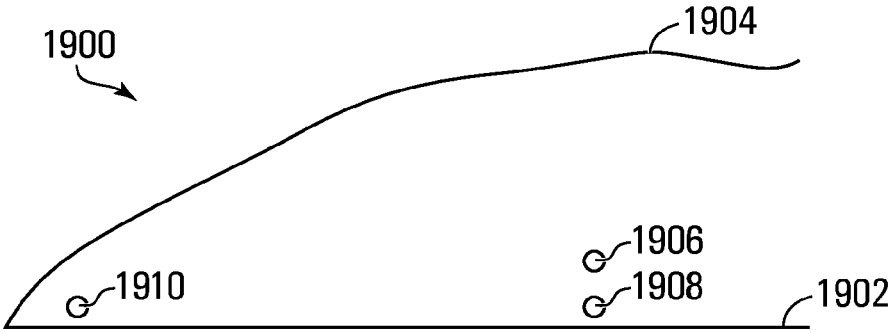
Figure 20:
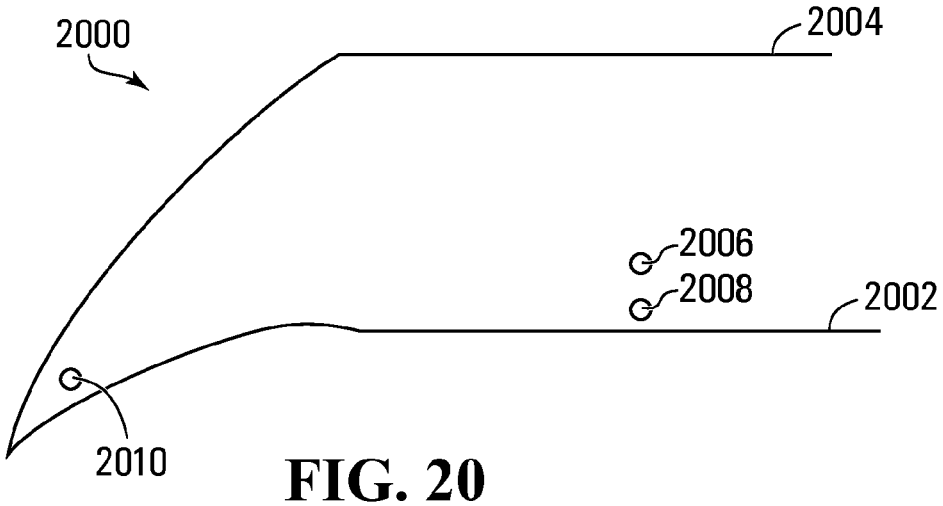
Figure 21:
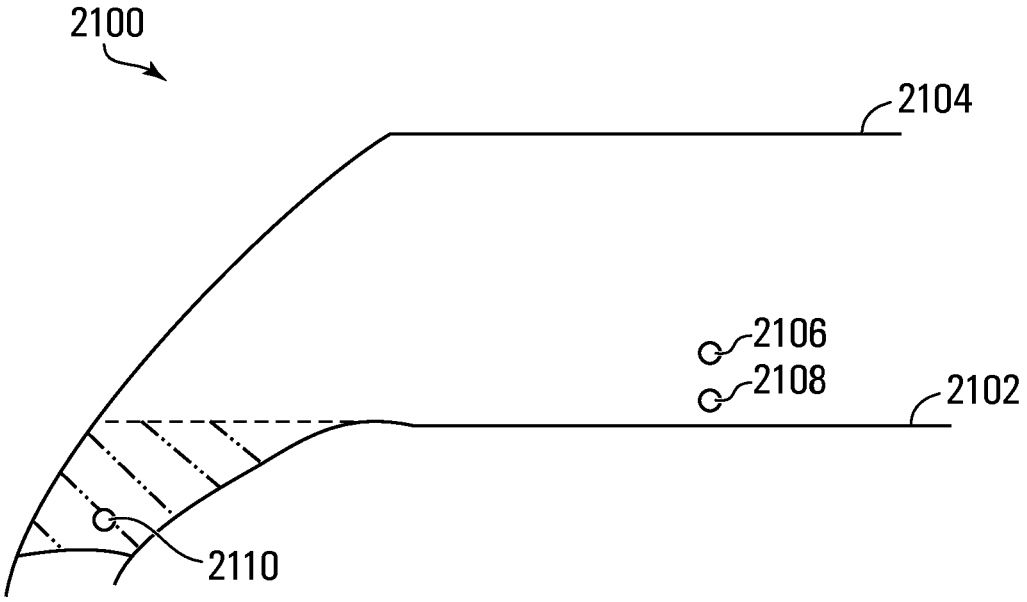

FIGS. 19, 20, and 21 illustrate embodiments in which a bypassed pay well 1910, 2010, or 2110 is positioned at an edge of a respective reservoir 1900, 2000, or 2100 where the cap layer 1904, 2004, or 2104 slopes downward to the level of the base 1902, 2002, or 2102. Each respective well arrangement includes a SAGD injection well 1906, 2006, or 2106 and a production well 1908, 2008, or 2108. The particular edge structure may vary as illustrated in FIGS. 19, 20, and 21. In any event, at the edge, there may be insufficient reservoir thickness to warrant the installation of a conventional SAGD well pair. However, if the heat generated from SAGD operation at injection well 1906, 2006, or 2106 and production well 1908, 2008, or 2108 can conduct to the edge and sufficiently mobilize the bitumen or petroleum in the edge region, bypassed pay well 1910, 2010, or 2110 may be conveniently utilized to produce hydrocarbons from the edge region. In some embodiments, the lateral distance between well 1910, 2010, or 2110 and production well 1908, 2008, or 2108 may be up to about 125 m. As illustrated in FIG. 21 a bypassed pay well near the edge of the pay, such as well 2110 may penetrate a water-rich region such as bottom water.

Figure 22:
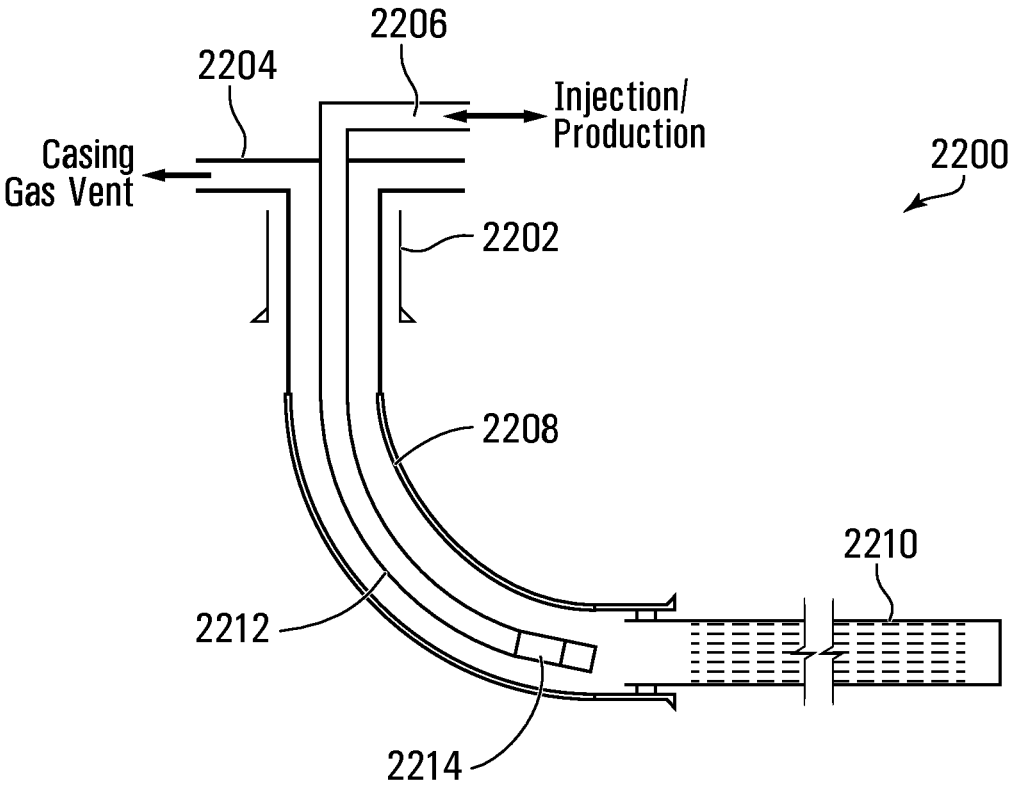
FIG. 22 is a schematic section view of a production well, according to a selected embodiment of the present invention.

FIG. 22 shows a possible configuration of a production well 2200 which may be either an overlying production well, or an underlying production well, or a bypassed pay well for producing hydrocarbons. Well 2200 includes a surface casing 2202, an inlet 2204, an outlet 2206, an intermediate casing 2208, a slotted liner 2210, a production tubing 2212, and a pump 2214. In some embodiments, the horizontal section of well 2200 may be about 300 to about 500 m long or longer. While the horizontal section of well 2200 is depicted to be straight, it should be understood that the actual section may be curved to follow a contour of the reservoir base, or to pass under an overlying well. Where it is beneficial, a tubing string may be suspended in liner 2210 from the casing shoe. Similar to typical SAGD producing wells, the well completions may vary slightly for each well to optimize circulation of heat to cooler areas. Casing and tubing sizes may be determined based on projected flow rates, pressure drops, and well lengths. The wells may vary in length due to the spatial extent of the resource and proximity to conductive heating. The wells may be configured to access approximately 300-500 m or more of bypassed pay varying in depths of 5-8 m below existing SAGD producers and wells drilled according to the WEDGE WELL™ technology.

The proposed well bore completion for wells 610, 710A, and 710B is illustrated in FIG. 22.

It is expected that it may be possible to recover between 18,000 to 32,000 $m^3$ of incremental bitumen over 5 years from each of wells 610, 710A, and 710B. The peak production rates are estimated to range between 50 and 75 $m^3$/d of bitumen and will decline based on the amount of heat and pressure support encountered. Further recovery may be possible dependant on economics such as market prices of oil at the time.

Wells 610, 710A, and 710B may be operated near the same pressures, approximately 2300 kPa, as the overlying SAGD producers and wells drilled according to the WEDGE WELL™ technology with an added fluid level head pressure of the 5-8 m vertical distance between the wells.

Wells 610, 710A, 710B may be tied into existing surface facilities on D and W01 Pads. It may not be necessary to provide additional permanent facilities to operate wells 610, 710A, and 710B.

Figure 23:
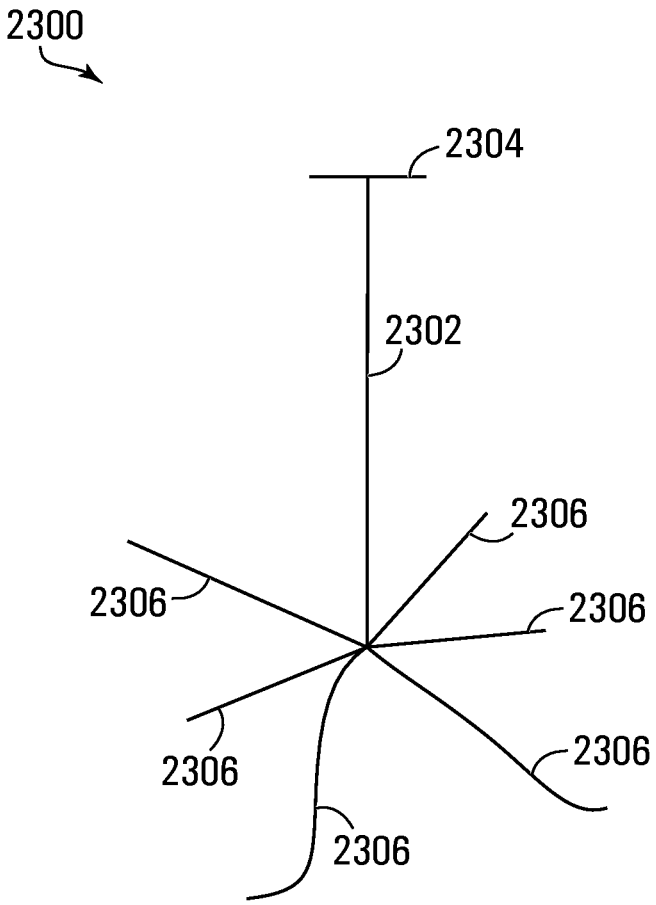
FIG. 23 is a schematic perspective view of a multilateral bypassed pay well, according to a selected embodiment of the present invention.

In selected embodiments, one or more vertical wells may be included in the well arrangement if appropriate. Further, a multilateral well may have a substantially vertical section extending from the earth surface. The location(s) of the vertical well(s) may be selected to reach the lowest elevation point in the reservoir above the base. For example, a multilateral bypassed pay well 2300 may be configured as shown in FIG. 23. Well 2300 has a vertical section 2302 which extends downward from earth's surface 2304, and a number of lateral well bore sections 2306 extending from the bottom end of vertical section 2302. Each lateral well bore section 2306 may extend under one or more production wells (not shown) or may follow a contour of the base.

While some selected embodiments are described for illustration purposes herein, it should be understood that variations and modifications to the described embodiments are possible as can be understood by those skilled in the art.

For example, as alluded to elsewhere, the timing of the inception of operations at the different wells may be dictated by economic considerations or operational preferences. Thus, in some circumstances it may be appropriate to initiate the operation of an underlying well after the overlying production wells are at or near the end of what would be their economic lives if no further action were taken. In other circumstances, however, the operation of an underlying well may be initiated at distinctly earlier stage in the life of the overlying well pairs. The timing may be selected so that it is economical to produce hydrocarbons from the underlying well, which may result from conduction of heat from the heated zones above the overlying production well. A further consideration for delaying production from the underlying well is the possible interference with the production performance of the overlying production well.

However, the operation of the overlying production wells may be also be adjusted or altered in consideration that further production may be carried out from the underlying well(s), to optimize the overall production from all of the production wells at the same site.

In some embodiments, the net result of operating a bypassed pay well, or both overlying and underlying production wells may be a material increase in recovered hydrocarbons over that which would have been achieved had the bypassed pay well or underlying well not been present. The increase may be achieved under the dominance of a high efficiency gravity-controlled flow mechanism. Furthermore, this material increase in recovered hydrocarbons may be achieved while not increasing and in most instances decreasing the cumulative steam-oil ratio. The overall recovered hydrocarbons may also be obtained economically, where recovery of the same amount of hydrocarbons from the same reservoir, while still possible, would be less economical without the presence of underlying well(s) or a well that follows the contour of the base.

Embodiments of the present invention may apply to any known heavy oil deposits or oil sand deposits.

It is known to those practiced in the art that a gravity-controlled process utilizing a particular mobilizing fluid, such as steam in the case of SAGD, or a set of mobilizing fluids in place of a single fluid, need not continue to use those fluids, or need not continue to use those fluids exclusively, throughout the life of the process wells. Thus, for example, in the case of SAGD, it is often prudent to curtail or even halt the injection of steam at a certain point in the life of the process, and inject an alternative or concurrent fluid, all the while maintaining gravity control.

Thus, in embodiments of the present invention, an underlying well or bypassed pay well may be designed to produce oil from below SAGD production well(s), where regions of the reservoir near the underlying well have been heated due to the steam chamber above and contain mobile hydrocarbons which cannot be recovered by the overlying SAGD production well(s) due to gravity.

An underlying well or bypassed pay well may have a length, elevation, trajectory, shape and design selected to optimize production of oil from the volume of reservoir below a series of SAGD producers.

An underlying well may be parallel to, perpendicular to, or at any angle to the SAGD producers, in a top plan view. The underlying well may have a length that is the same, longer, or shorter than the overlying SAGD producer(s).

An underlying well or bypassed pay well may have a well bore diameter that is the same, smaller, or larger than diameter of the SAGD producer(s).

In some embodiments, an underlying well or bypassed pay well may be straight. In other embodiments, an underlying well or bypassed pay well may be curved.

In some embodiments, an underlying well may cross under a single well pair above. In some embodiments, an underlying well may cross under overlying production wells over an entire well pad, or an entire well field.

An underlying well or bypassed pay well may have a single bore or may include one or more multilaterals instead of multiple wells all drilled separately from the surface. For example, multiple horizontal well bores may be drilled from a single main well bore which is drilled form surface in order to reduce the overall cost of the bypassed pay wells. The horizontal well bores may each follow a different valley on the base of the reservoir. The horizontal well bores may be aligned in a generally parallel arrangement or aligned independent from each other. The horizontal well bores may also extend radially outward from one location.

The trajectory of a bypassed pay well or an underlying well may follow low points on the structure of an impermeable formation that defines the base of the reservoir pay.

As can be understood, hydrocarbons recoverable from a bypassed pay well or an underlying well may be present for a number of reasons. For example, drilling constraints may prevent drilling an overlying production well, such as a SAGD producer, down into the low points on the contour of the base. Due to practical uncertainty during drilling, an overlying production well such as a SAGD producer may be drilled to an elevation higher than planned or intended, thus leaving a region of the pay above the base below the resulting well. In some cases, SAGD producers are intentionally drilled away and above the base of the pay due to uncertainty in the lateral extent and continuity of potential flow barriers. In some cases, SAGD process constraints can limit the allowable elevation variability along the length of a well pair. In some cases, problems, such as liner plugging, can develop in a SAGD producer during operation, which prevent drainage of fluids over a section of the SAGD producer. Mobile petroleum fluids may sink below a SAGD producer during operation, such as when there is bottom water, or a lean or transition zone below the SAGD well pair which is re-saturated with hydrocarbons from above when the zone is heated due to the higher density of the oil at typical SAGD operating conditions.

In some embodiments, an underlying well or bypassed pay well may be operated to produce hydrocarbons without further heating, aid, or treatment of the adjacent pay. In other embodiments, the pay may be stimulated with a steam slug before production operation. In some embodiments, the well may be operated cyclically for an extended period of time.

In some embodiments, an underlying well or bypassed pay well may be operated at a late stage in the life of a SAGD well pair, or a well pad, or a recovery area, to limit potential for impacting the performance of pre-existing wells.

An underlying well or bypassed pay well may be planned prior to drilling other wells such as SAGD well pairs, in which case the other wells may be placed to minimize risk and optimize steam-to-oil ratio (SOR), and the overall oil recovery may be optimized by placement of underlying or bypassed pay well(s). As it is not necessary to place the other wells to balance optimizing recovery and SOR, a greater SOR may be initially achieved, without compromising the overall oil recovery.

It will be understood that any singular form is intended to include plurals herein. For example, the word "a", "an" or "the" is intended to mean "one or more" or "at least one." Plural forms may also include a singular form unless the context clearly indicates otherwise.

It will be further understood that the term "comprise", including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used. For any list of possible elements or features provided in this specification, any sub-list falling within the given list is also intended.

Similarly, any range of values given herein is intended to specifically include any intermediate value or sub-range within the given range, and all such intermediate values and sub-ranges are individually and specifically disclosed.

Of course, the above described embodiments are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A process comprising:

producing hydrocarbons from a first production well in a subterranean reservoir by a gravity-controlled recovery process, wherein the first production well is paired with an injection well for injecting a fluid to mobilize viscous hydrocarbons in a region in the reservoir, and the injection well and the first production well are substantially horizontal and parallel to one another, the reservoir is formed above a contoured base, hydrocarbons in a region of the reservoir are mobilized by heating or an injected fluid; and when or after the injection well and the first production well are operated in a blowdown phase, or after a production rate from the first production well has reduced, producing hydrocarbons from an unpaired second production well extending below the first production well, wherein the second production well comprises a contour section that follows a contour of a depression on the contoured base and is positioned in a bypassed portion of the region containing hydrocarbons that are mobilized due to operation of the injection well and the first production well and are unproducible from the first production well, to collect mobilized hydrocarbons in the bypassed portion of the region by gravity drainage, without steam injection into the bypassed portion through the second production well or another well below the first production well, wherein mobilized hydrocarbons in the bypassed portion tend to accumulate at the depression, wherein the second production well extends under and across the first production well, and the contour section of the second production well under the first production well is shielded from receiving fluids from the reservoir, so as to limit interference with production of the fluids from the first production well.

2. The process of claim 1, wherein the second production well extends over the lowest region of the depression.

3. The process of claim 1, wherein the second production well extends in a valley or a basin defined by the contoured base, so as to trace a local minimum of elevation of a top surface of the contoured base.

4. The process of claim 1, wherein the second production well comprises a branched well bore comprising a plurality of lateral branches, and the contour section is in a lateral branch of the branched well bore.

5. The process of claim 1, wherein the second production well penetrates a region above the depression, wherein the region contains a volume of water.

6. The process of claim 1, wherein a maximum distance between the contour section of the second production well and the contoured base is from 0 to 3 m.

7. The process of claim 1, wherein a distance between the first production well and the contoured base is more than 3 m.

8. The process of claim 1, wherein the first production well comprises a branched well bore, and the contour section extends between the contoured base and one or more branches of the branched well bore.

9. The process of claim 1, comprising producing hydrocarbons from a plurality of wells each comprising a contour section that follows a contour of the contoured base.

10. The process of claim 1, wherein the gravity-controlled recovery process is a steam-assisted gravity drainage process.

11. The process of claim 1, wherein the injection well and the first production well are positioned and configured to optimize an initial rate of hydrocarbon production from a pay region of the reservoir through the first production well; and the second production well is positioned and configured to optimize an amount of hydrocarbon recovery from the pay region of the reservoir.

12. The process of claim 1, wherein production of hydrocarbons from the second production well commences after termination of hydrocarbon production from the first production well.

13. The process of claim 1, wherein the fluid injected from the injection well comprises steam, and the mobilized hydrocarbons in the bypassed portion comprise hydrocarbons mobilized by conductive heating.

14. An arrangement of wells for producing hydrocarbons from a subterranean reservoir, comprising:

a well pair in the reservoir comprising an injection well for injecting a fluid into the reservoir to mobilize viscous hydrocarbons and a first production well paired with the injection well for producing mobilized hydrocarbons from the reservoir in a gravity-controlled recovery process, wherein the injection well and the first production well are substantially horizontal and parallel to one another; and an unpaired second production well in the reservoir for producing hydrocarbons from the reservoir by gravity drainage, the second production well extending under and across the first production well, wherein the reservoir is formed above a contoured base, and the second production well comprises a contoured well bore section that follows a contour of a depression on the contoured base and is positioned in a bypassed portion of the reservoir to produce hydrocarbons mobilized due to operation of the injection well and the first production well but unproducible from the first production well, wherein a contoured portion of the contoured well bore section of the second production well under the first production well is shielded from receiving fluids from the reservoir, so as to limit interference with production of fluids from the first production well, wherein mobilized hydrocarbons in the bypassed portion tend to accumulate at the depression.

15. The arrangement of claim 14, wherein a maximum distance between the contoured well bore section and the contoured base is from 0 to 3 m.

16. The arrangement of claim 15, wherein a distance between the first production well and the contoured base is from about 5 to 15 m.

17. The arrangement of claim 14, wherein the second production well extends in a valley or a basin defined by the contour of the base, so as to trace a local minimum of elevation of a top surface of the contoured base.

18. The arrangement of claim 14, wherein the second production well penetrates a region above the base, wherein the region contains a volume of water.

19. The arrangement of claim 14, wherein the second production well comprises a branched well bore comprising a plurality of lateral branches.

20. The arrangement of claim 14, wherein the gravity-controlled recovery process is a steam-assisted gravity drainage process.

21. The arrangement of claim 14, wherein the first production well comprises a branched well bore comprising a plurality of lateral branches, and wherein the second production well extends under one or more lateral branches of the branched well bore of the first production well.

22. The arrangement of claim 14, comprising a plurality of first production wells in the reservoir for producing hydrocarbons from the reservoir, wherein the second production well extends under at least two of the first production wells.

23. The arrangement of claim 22, wherein the first production wells extend substantially horizontally and parallel to one another.

24. The arrangement of claim 14, comprising a plurality of second production wells each extending under at least one first production well.

25. The arrangement of claim 14, wherein the injection well and the first production well are positioned and configured to optimize an initial rate of hydrocarbon production from a pay region of the reservoir through the first production well; and the second production well is positioned and configured to optimize an amount of hydrocarbon recovery from the pay region of the reservoir.

26. The arrangement of claim 14, wherein a distance between the first production well and the contoured base is more than 3 m.

* * * * *